US010507479B2

(12) United States Patent
Bertness et al.

(10) Patent No.: US 10,507,479 B2
(45) Date of Patent: Dec. 17, 2019

(54) DISPENSING NOZZLE

(71) Applicant: Cornelius, Inc., Osseo, MN (US)

(72) Inventors: Elizabeth Bertness, Batavia, IL (US); Nancy Fortunato, Wauconda, IL (US); Loren Veltrop, Chicago, IL (US)

(73) Assignee: Cornelius, Inc., Osseo, MN (US)

( * ) Notice: Subject to any disclaimer, the term of this patent is extended or adjusted under 35 U.S.C. 154(b) by 0 days.

(21) Appl. No.: 15/799,438

(22) Filed: Oct. 31, 2017

(65) Prior Publication Data

US 2018/0117606 A1 May 3, 2018

Related U.S. Application Data

(60) Provisional application No. 62/415,801, filed on Nov. 1, 2016.

(51) Int. Cl.

| | |
|---|---|
| ***B05B 7/04*** | (2006.01) |
| ***B67D 1/00*** | (2006.01) |
| ***B01F 13/10*** | (2006.01) |

(52) U.S. Cl.

CPC ..... *B05B 7/0408* (2013.01); *B01F 13/1055* (2013.01); *B67D 1/0021* (2013.01); *B67D 1/0044* (2013.01); *B67D 1/0046* (2013.01); *B01F 2215/0014* (2013.01)

(58) Field of Classification Search

CPC ..... B67D 1/0083; B67D 1/0051–0052; B67D 1/0044; B67D 1/0046–0048; B67D 2001/0093–0094; B67D 1/0021–0039; G01K 13/02

See application file for complete search history.

(56) References Cited

U.S. PATENT DOCUMENTS

| | | | | |
|---|---|---|---|---|
| 1,261,986 A * | 4/1918 | White | B67D 1/0021 134/199 |
| 2,297,497 A * | 9/1942 | Popoff | B05B 7/0466 239/424 |
| 2,537,119 A | 1/1951 | Buerlein et al. | |
| 2,736,466 A * | 2/1956 | Rodth | B67D 1/0031 137/99 |
| 2,953,305 A * | 9/1960 | Bondurant | B05B 7/1209 239/353 |

(Continued)

FOREIGN PATENT DOCUMENTS

| | | |
|---|---|---|
| GB | 2042351 | 9/1980 |
| GB | 2340415 | 2/2000 |

(Continued)

OTHER PUBLICATIONS

Final Office Action for U.S. Appl. No. 15/698,164, dated Sep. 13, 2019.

*Primary Examiner* — Paul R Durand
*Assistant Examiner* — Randall A Gruby
(74) *Attorney, Agent, or Firm* — Andrus Intellectual Property Law, LLP

(57) ABSTRACT

Dispensing nozzles and systems for dispensing edible products include a nozzle sleeve and a nozzle insert. The nozzle sleeve defines an open interior and the nozzle insert is positioned within the nozzle sleeve. A base inlet and a flavoring inlet are defined in the nozzle insert. The nozzle sleeve and the nozzle insert are configured to mix a base substance with a flavoring substance.

10 Claims, 15 Drawing Sheets

(56) References Cited

U.S. PATENT DOCUMENTS 3,118,758 A * 1/1964 Ross ..... C21B 13/0026 239/422
3,128,994 A * 4/1964 Hungate ..... B01F 5/20 239/424
3,297,255 A * 1/1967 Fortman ..... B05B 1/265 116/137 A
3,373,937 A * 3/1968 Yuza ..... B67D 1/1405 222/547
3,455,332 A * 7/1969 Cornelius ..... B01F 5/0077 137/381
3,460,717 A 8/1969 Thomas
3,468,487 A * 9/1969 Warren ..... F02K 9/52 239/403
3,575,352 A 4/1971 Hall et al.
3,664,552 A * 5/1972 Carse ..... B67D 1/0084 222/144.5
3,966,091 A * 6/1976 Bencic ..... B67D 1/005 222/129.1
4,218,014 A 8/1980 Tracy
4,635,825 A 1/1987 Tulasne
4,708,266 A 11/1987 Rudick
4,753,370 A 6/1988 Rudick
4,792,402 A 12/1988 Fricker
4,928,854 A 5/1990 McCcann et al.
4,967,932 A 11/1990 Wiley et al.
5,000,351 A * 3/1991 Rudick ..... B67D 1/0036 222/105
5,025,840 A 6/1991 Tacke
5,033,651 A 7/1991 Whigham et al.
5,102,016 A 4/1992 Ball et al.
5,203,474 A * 4/1993 Haynes ..... B67D 1/0044 222/129.1
5,308,631 A 5/1994 Anglerot
5,366,117 A 11/1994 Mesenbring et al.
5,415,326 A * 5/1995 Durham ..... B67D 1/0044 222/129.1
5,429,681 A 7/1995 Mesenbring
5,435,466 A 7/1995 Du
5,549,222 A 8/1996 Schroeder
5,566,863 A 10/1996 Mesenbring et al.
5,570,822 A 11/1996 Lemarbe et al.
5,649,644 A 7/1997 Hashimoto et al.
5,799,832 A 9/1998 Mayo
5,803,320 A * 9/1998 Cutting ..... B67D 1/0036 222/129.1
6,003,733 A 12/1999 Wheeler
6,016,935 A 1/2000 Huegerich et al.
6,047,859 A 4/2000 Schroeder et al.
6,095,371 A 8/2000 Mooney
6,189,736 B1 2/2001 Phallen et al.
6,220,047 B1 4/2001 Vogel et al.
6,227,420 B1 5/2001 Jepson
6,253,963 B1 7/2001 Tachibana
6,328,229 B1 12/2001 Duronio et al.
6,345,729 B1 2/2002 Santy
6,357,632 B1 3/2002 Salmela
6,390,662 B1 5/2002 Henry et al.
6,481,645 B1 11/2002 Taylor-McCune et al.
6,689,410 B2 2/2004 Gerber
6,698,229 B2 3/2004 Renken et al.
6,719,175 B2 4/2004 Mackenzie et al.
6,722,530 B1 4/2004 King et al.
6,739,524 B2 5/2004 Taylor-McCune et al.
6,745,592 B1 6/2004 Edrington et al.
6,871,761 B2 3/2005 Fox
7,059,761 B2 6/2006 Gerber
7,159,743 B2 1/2007 Brandt et al.
7,243,818 B2 7/2007 Jones
7,337,920 B2 3/2008 Duck et al.
7,445,133 B2 * 11/2008 Ludovissie ..... B67D 1/0021 222/129.1
7,487,887 B2 2/2009 Ziesel
7,559,346 B2 7/2009 Herrick et al.
7,717,297 B2 5/2010 Kadyk et al.
7,757,896 B2 7/2010 Carpenter et al.
7,878,370 B2 2/2011 Sevcik et al.
7,997,448 B1 8/2011 Leyva
8,091,737 B2 1/2012 Smeller et al.
8,113,386 B2 2/2012 Herrick et al.
8,167,173 B1 5/2012 Simmonds et al.
8,245,629 B2 8/2012 Little
8,322,570 B2 12/2012 Beavis et al.
8,490,829 B2 7/2013 Deo et al.
8,496,191 B2 * 7/2013 Grant ..... F02M 45/086 239/423
8,561,841 B2 10/2013 Erman et al.
8,584,900 B2 11/2013 Metropulos et al.
8,622,257 B2 1/2014 Erman et al.
8,631,974 B2 2/2014 Piatnik et al.
8,798,799 B2 8/2014 Deo et al.
8,807,392 B2 * 8/2014 Smeller ..... A47J 31/402 222/129.1
8,839,989 B2 11/2014 Olson et al.
8,893,927 B2 11/2014 Olson et al.
8,899,280 B2 12/2014 Deo et al.
9,026,245 B2 5/2015 Tilton et al.
9,388,033 B2 * 7/2016 Gates ..... B67D 1/0044
RE46,143 E 9/2016 Erman et al.
9,622,615 B2 4/2017 Hecht et al.
10,071,899 B2 * 9/2018 Mastro ..... B67D 1/0044
2002/0083730 A1 7/2002 Giroux et al.
2003/0161923 A1 8/2003 Holland et al.
2004/0159676 A1 8/2004 Adema
2005/0051577 A1 3/2005 Loeb et al.
2005/0067433 A1 3/2005 Brandt et al.
2006/0157504 A1 7/2006 Barker et al.
2006/0196886 A1 9/2006 Fox
2008/0041876 A1 2/2008 Frank et al.
2008/0073376 A1 3/2008 Gist et al.
2008/0083780 A1 4/2008 Romanyszyn et al.
2008/0314918 A1 12/2008 Nuriely
2009/0095771 A1 4/2009 Hoover
2009/0120958 A1 5/2009 Landers et al.
2009/0230149 A1 * 9/2009 Smeller ..... B67D 1/0024 222/145.5
2010/0133293 A1 * 6/2010 Ziesel ..... B67D 1/0044 222/1
2010/0147875 A1 6/2010 Santos et al.
2011/0264285 A1 10/2011 Mattos et al.
2012/0126034 A1 5/2012 Nolen et al.
2012/0285329 A1 11/2012 Verhoeven et al.
2013/0096715 A1 4/2013 Chung et al.
2013/0177261 A1 7/2013 Bushnaw
2013/0200103 A1 8/2013 Gates
2013/0206793 A1 8/2013 Minica et al.
2013/0282169 A1 10/2013 Moore et al.
2014/0069953 A1 3/2014 Metropulos et al.
2014/0081777 A1 3/2014 Mastrodonato et al.
2014/0114469 A1 4/2014 Givens et al.
2014/0263414 A1 9/2014 San Miguel et al.
2014/0372233 A1 12/2014 Knecht et al.
2015/0017297 A1 1/2015 Vastardis et al.
2015/0046877 A1 2/2015 Cuppari et al.
2016/0068383 A1 3/2016 Falco, III
2016/0229675 A1 8/2016 Popov et al.
2016/0332176 A1 * 11/2016 Mastro ..... B67D 1/0044
2017/0119199 A1 5/2017 Williston et al.
2017/0122444 A1 5/2017 Wilson et al.
2017/0122449 A1 5/2017 Wilson et al.
2017/0122450 A1 5/2017 Wilson et al.
2017/0122451 A1 5/2017 Wilson et al.
2017/0123509 A1 5/2017 Erman et al.
2017/0190554 A1 7/2017 Dahlberg et al.
2017/0233234 A1 * 8/2017 Hecht ..... B67D 1/0052 222/129.1
2017/0349423 A1 * 12/2017 Hecht ..... B67D 1/0052
2018/0072555 A1 * 3/2018 Fortunato ..... G07F 13/06
2018/0072557 A1 * 3/2018 Bertness ..... G07F 13/06
2018/0111173 A1 * 4/2018 Bertness ..... B08B 9/0325
2018/0265342 A1 * 9/2018 Smeller ..... B67D 1/0037

(56) References Cited

U.S. PATENT DOCUMENTS

FOREIGN PATENT DOCUMENTS

| | | |
|---|---|---|
| WO | 9927070 | 6/1999 |
| WO | 2007087611 | 8/2007 |
| WO | 2012135917 | 10/2012 |
| WO | 2014062915 | 4/2014 |
| WO | 2014151946 | 9/2014 |

* cited by examiner

DISPENSING NOZZLE

CROSS-REFERENCE TO RELATED APPLICATION

The present application claims priority of U.S. Provisional Patent Application No. 62/415,801, filed on Nov. 1, 2016, the content of which is hereby incorporated herein by reference in its entirety.

BACKGROUND

The present disclosure relates to the dispensing of custom food products. More specifically, the present disclosure relates to nozzles for mixing two or more substances to dispense a custom mixture.

As restaurants, concessions, and vending services move towards increased customized product offerings and consumers look for a more personalized food experience, vendors are looking for new ways to incorporate these trends. A dispenser of custom flavored food products is thus desirable in the field. Mixing of custom flavored food products presents challenges as two one or more semi-solid food stuffs are designed to be mixed into a homogenous or semi-homogenous product for delivery to the user for consumption.

U.S. Patent application Publication No. 2010/0147875 discloses a device for introducing additive fluids to a primary fluid that includes a body having a central bore for flow therethrough of a stream of primary fluid and a plurality of fluid flow channels in the body. Each channel extends between an inlet to the channel for connection to an associated supply of additive fluid and a plurality of outlet orifices from the channel that open into a surface of the body around and outside of an exit from the central bore.

U.S. Patent application Publication No. 2016/0332176, entitled "Apparatuses, Systems, and Method for Dispensing Condiments," which is hereby incorporated by reference herein in its entirety, discloses dispensing of condiments having a base component and at least one additive. U.S. patent application Ser. No. 15/353,494, entitled "Systems and Methods of Custom Condiment Dispensing," which is hereby incorporated by reference herein in its entirety, discloses dispensers and methods for dispensing custom condiments. U.S. patent application Ser. No. 15/585,974, entitled "Frozen Beverage Dispensing Machines with Multi-Flavor Valves," which is hereby incorporated by reference herein in its entirety, discloses valves and nozzles for dispensing a mixed beverage having a base fluid and an additive fluid.

BRIEF DISCLOSURE

An exemplary embodiment of a nozzle for dispensing an edible product includes a nozzle sleeve that defines an open interior. A nozzle insert is positioned within the nozzle sleeve. A base inlet is defined in the nozzle insert. The base inlet opens to a base chamber within the open interior of the nozzle sleeve and defined at least in part by the nozzle insert. A flavoring inlet is defined in the nozzle insert. The nozzle sleeve and the nozzle insert are configured to mix by sheer mixing a base substance received through the base inlet with at least one flavoring substance received through the flavoring inlet.

An exemplary embodiment of a dispensing system for an edible product includes a nozzle. The nozzle includes a nozzle sleeve which defines an open interior. A nozzle insert is positioned within the nozzle sleeve. A base inlet is defined in the nozzle insert. The base inlet opens to a base chamber within the open interior of the nozzle sleeve and is defined at least in part by the nozzle insert. A flavoring inlet is defined in the nozzle insert. The nozzle sleeve and the nozzle insert are configured to mix by sheer mixing a base substance received through the base inlet with at least one flavoring received through the flavoring inlet. A mounting bracket is secured to a housing of the dispensing system. The mounting bracket is configured to releasably engage the nozzle sleeve to releasably retain the nozzle to the housing. A diffuser is configured to connect to a plurality of flexible tubes. Each flexible tube of the plurality of flexible tubes is configured to convey a flow of flavoring substance. The diffuser directs the flow of flavoring substance from the plurality of flexible tubes through the flavoring inlet.

DETAILED DISCLOSURE

Embodiments disclosed herein will use the use case of a custom condiment dispenser for exemplary purposes to described aspects of the disclosed nozzle. It will be recognized that as referred to herein, condiment and flavorings can encompass a variety of semi-solid or semi-liquid edible substances having a range of viscosities and consistencies. It will be recognized that while embodiments of the nozzles as disclosed herein may be particularly suited to facilitate the dispense and mixing of condiments, that embodiments of the nozzle may be used to mix and dispense any of a variety of edible substances including semi-solid and liquid edible substances such as liquid condiments, including but not limited to liquid butter, oils, and/or salad dressing or may be used to mix and dispense flavored beverages or other uses as disclosed herein.

As used herein the term "shear mixing" refers to the mixing of two or more substances due to the shear stress between the boundaries of those substances. As disclosed herein, this may exemplarily, but not limited to, be due to convergence, impingement, or laminar flow of the two or more substances. As also disclosed in further detail herein, such laminar flow may be coaxially laminar flow.

It will be recognized that as used herein "mixing" need not result in a homogenous mixture between the base condiment and the at least one flavoring and that a custom condiment may be "mixed" without being completely uniform in distribution of constituent components or uniform in color.

Figure 1:
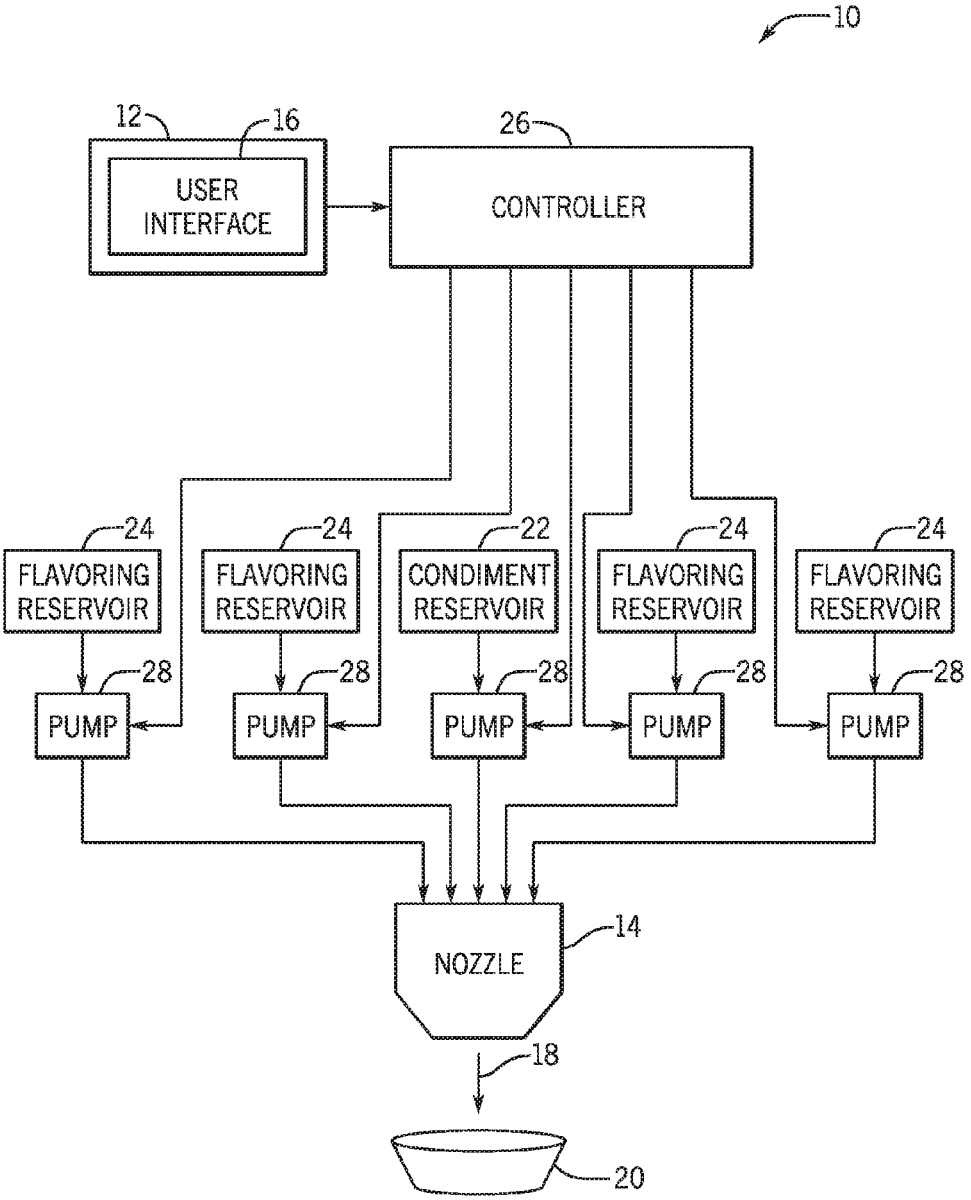
FIG. 1 is a system diagram that depicts an exemplary embodiment of a custom dispenser.

FIG. 1 is a system diagram that depicts an exemplary embodiment of a custom condiment dispenser 10. The custom condiment dispenser 10 exemplarily includes a graphical display 12, which may also function as a user input device by visually presenting a graphical user interface 16. The graphical display 12 is exemplarily a touch screen graphical display that is operable as a user interface, although it will be recognized that in other embodiments, other forms of user interfaces including but not limited to physical keyboards, gesture, as well as wireless embodiments including WI-FI and/or BLUETOOTH protocols for communication with a smart phone or other handheld wireless device may be used.

The custom condiment dispenser 10 further includes a nozzle 14 through which the edible substance, for example a custom condiment 18 is dispensed. While FIG. 1 depicts an exemplary embodiment with a single nozzle 14 connected to a single base condiment reservoir 22 and four flavoring reservoirs 24 as will be described in further detail herein, it will be recognized that other embodiments of the dispenser 10 may include any number of condiments, flavorings, and/or nozzles for the mixing and dispense of customer condiments. The custom condiment may be dispensed into a receptacle 20, exemplarily a portion cup, a food item, or a refillable bottle. In other uses, the custom condiment 18 may be dispensed directly onto a food item (not depicted) for example, a sandwich, a hamburger, or a hot dog.

It will be recognized that embodiments of the custom condiment dispenser 10 may operate in a variety of ways to dispense various types of custom condiments while remaining within the scope of the present disclosure. In an exemplary embodiment, the custom condiment dispenser 10 may include a base condiment reservoir 22, for example, but not limited to a reservoir 22 for ketchup, mayonnaise, barbecue sauce, or ranch dressing. The custom condiment dispenser 10 further includes flavoring reservoirs 24. As will be described in further detail herein, the flavorings contained within the flavoring reservoirs 24 and used by the condiment dispenser 10 may take a variety of forms including, but not limited to liquid concentrated flavoring, or a concentrated flavoring sauce. In an alternative embodiment, liquid flavoring of any variety of concentrations may be used depending upon the substance being mixed and dispensed. It is understood that the flavoring reservoirs 24 may be adapted to contain and dispense a particular type of flavoring. Upon user operation of the user interface 16 presented on the graphical display 12 to select a custom condiment to dispense, a controller 26 operates the custom condiment dispenser 10 to dispense the combination of the base condiment from the condiment reservoir 22 and at least one of the appropriately selected flavorings from flavoring reservoirs 24 to produce the selected custom condiment 18.

Each of the at least one base condiment reservoir 22 and plurality of flavoring reservoirs 34 are exemplarily connected to pumps 28 which respectively pump the base condiment and at least one flavoring to the nozzle 14. In an exemplary embodiment, a flexible tube may connect each of the reservoirs 22, 24 to at least one of the pumps 28. In exemplary embodiments, the pumps 28 are peristaltic pumps that operate to push the base condiment and/or flavoring through the respective flexible tubes. The flexible tubes exemplarily extend through the pumps 28 and prevent the pumps 28 from being in contact with the food flowing through the flexible tubes, e.g. the base condiment or flavoring.

The reservoirs 22, 24 may be refillable and reusable containers, however, it will be recognized that other embodiments may use any of a wide variety of reservoirs. Alternative examples of reservoirs may include, but are not limited to, disposable packaging such as bags, boxes, and bag-in-box packaging. Still further examples of reservoirs may include movable or removable lids to facilitate refilling of reservoirs with additional base condiment or flavoring. In still further examples, the reservoirs may be Tillable through an opening with a removable cap, for example a removable cap which facilitates connection of the reservoir to the condiment dispenser.

In the present disclosure, the examples of a base condiment of ketchup will be used for exemplary purposes, although it will be recognized by a person of ordinary skill in the art that other condiments, including, but not limited to mustard, melted or liquid butter, olive oil, melted or liquid cheese sauce, yogurt, ranch, guacamole, sour cream, chili, and/or tartar sauce may be used. In addition to the above savory foods, sweet foods for example sauces, syrups, and other toppings for example chocolate, butterscotch, caramel, and strawberry may be dispensed in other embodiments. As noted above, still further embodiments of the nozzle disclosed herein may be used to mix and dispense beverages.

In non-limiting examples, flavors such as sriracha, buffalo, jalapeno, teriyaki, honey, onion, garlic, bacon, oak, soy sauce, smoke, pepper, vinegar, pickle, chili, mint, basil, and/or wasabi may be used although it will be recognized that these examples of flavorings are again merely exemplary of possible flavors and are not intended to be limiting on the scope of flavors that may be provided in a custom condiment dispenser in either of liquid or flavored sauce form. While guacamole and tarter were exemplarily identified above as examples of base condiments, it may also be recognized that those substances may exemplarily be produced as custom condiments when other base substances are used in combination with further examples of flavorings. For example in the case of guacamole, a base condiment of sour cream may be combined with avocado and onion and/or jalapeno to produce guacamole. While tarter sauce may be produced by a combination of a base condiment of mayonnaise with onion and pickle relish flavorings.

As previously noted, the flavorings may come in a variety of forms. In one exemplary embodiment, the flavorings are a concentrated liquid flavoring. Such concentrated liquid flavorings may be exemplarily water, alcohol, or oil based and potentially highly concentrated and therefore may require volumetrically a small amount of the flavoring to achieve the custom condiment. In such embodiments, the flavoring reservoirs and associated pumps may be comparatively small to handle these volumes. In another embodiment, the flavoring may be in the form of a flavored sauce.

Exemplarily, the flavored sauce may be a liquid starch sauce that carries the flavoring. This increases the volume of the flavoring which can promote mixing of the custom condiments in embodiments as disclosed in further detail herein. In further exemplary embodiments, the carrier sauce may be mixed with varying concentrations of the flavoring to produce different intensities of flavor for custom condiments further as described herein. In still further embodiments, the intensity or strength of a particular flavor in a custom condiment may be adjusted based upon an amount of flavoring mixed with the base condiment rather than an adjustment to a concentration of the flavoring itself.

In an exemplary embodiment, a user interacts with the custom condiment dispenser 10 through the GUI 16. The user inputs selections of a base condiment and at least one flavoring for a requested custom condiment. The user input selections may further include an intensity or amount of a flavoring to be added. After the user has input selections for the custom condiment, the user selects a dispense button to request dispense of the selected custom condiment. The condiment dispenser operates to provide the base condiment and at least one flavoring to the nozzle 14 for mixing and dispense of the requested custom condiment.

FIGS. 2-8 depict exemplary embodiments of nozzles which may be used in exemplary embodiments of custom condiment dispensers. In general, each nozzle receives a flow of a base substance and a flow of at least one flavoring substance out of a plurality of potential flows of flavoring substances. In exemplary embodiments the base substance and the at least one flavoring substance can mix in the nozzle, as the base substance and at least one flavoring substance exits the nozzle, and/or after the base substance and at least one flavoring substance is received within a receptacle. While one or more of these mixing actions may be used in embodiments disclosed herein, it will be recognized that the mixed substances need not result in a homogenous mixture between the substances to be mixed with the present disclosure.

Figure 2:
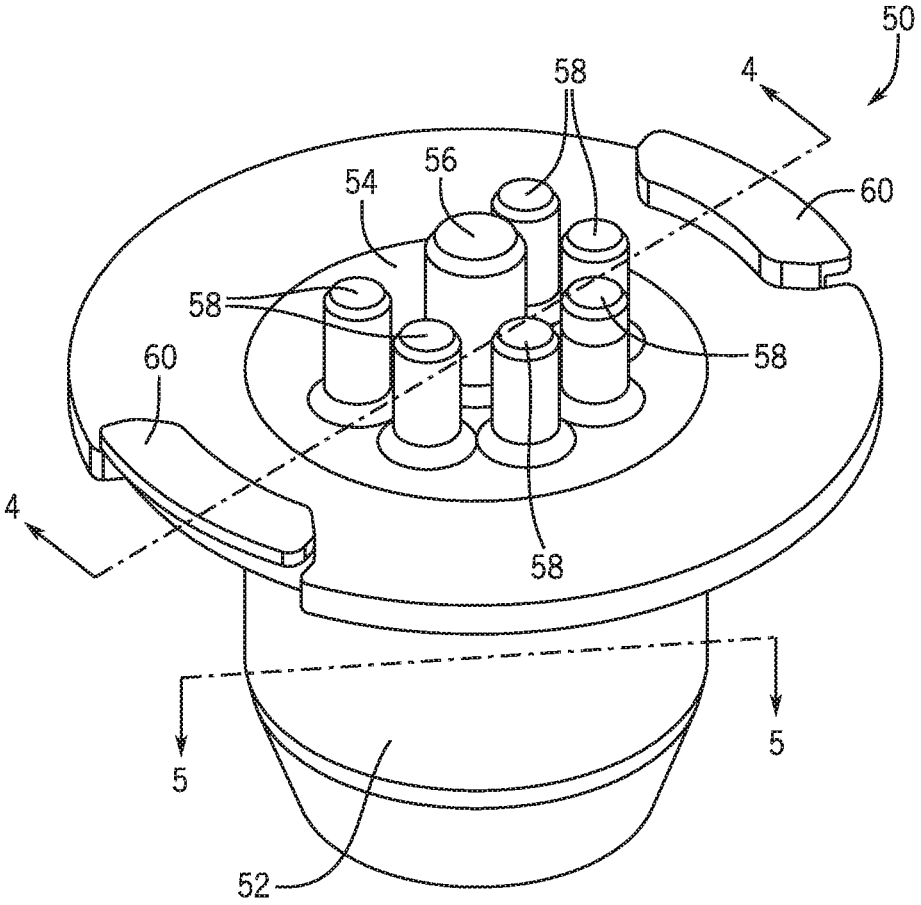
FIG. 2 depicts an exemplary embodiment of a nozzle.

FIG. 2 depicts an exemplary embodiment of a nozzle 50 as may be used to mix custom flavored substances, including, but not limited to viscous foods and/or beverages. The nozzle 50 may be suited to dispense a custom flavored condiment as described in embodiments herein. The nozzle 50 includes a nozzle sleeve 52 which receives a nozzle insert 54 therein. The nozzle 50 includes a base inlet 56 and a plurality of flavoring inlets 58. In the exemplary embodiment depicted in FIG. 2, the base inlet 56 and the flavoring inlets 58 are located in the nozzle insert 54, although as will be described in further detail herein, in other embodiments either or both of these inlets may extend through the nozzle sleeve 52. In an exemplary embodiment, the base inlet 56 and the flavoring inlets 58 exemplarily include barb connectors, although it will be recognized that other forms of connectors may be used in other embodiments. The connectors as shown in FIG. 2 may be configured to be secured to flexible tubes through which the base or flavoring is provided to the nozzle 50. In still other embodiments as disclosed herein, the barb connectors may be configured to secure the nozzle 50 to a manifold or to a gasket which facilitates connection between the nozzle 50 and the dispenser 10.

The nozzle 50 further includes a pair of tabs 60 which exemplarily are used to connect in a bayonet fashion with the dispensing apparatus. In an embodiment, the tabs 60 are configured to be received within respective slots in a dispenser (not depicted) in the area about where the condiment is dispensed. The nozzle 50 can be engaged with the dispenser with a turn about a portion of a rotation. In non-limiting examples, this may include a ⅛ turn or ¼ turn. In an exemplary embodiment, such connection facilitates ease of removal and reconnection of the nozzle 50 in order to facilitate cleaning of the nozzle and/or replacement of the nozzle.

Figure 3:
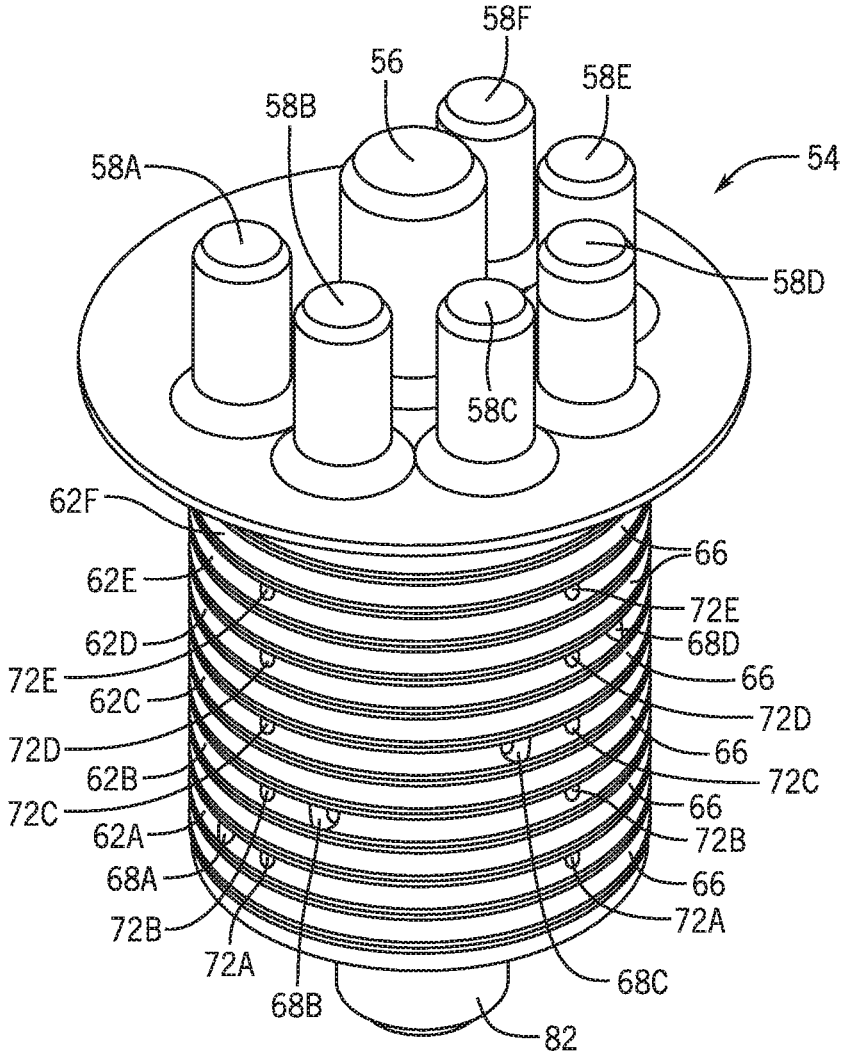
FIG. 3 depicts an exemplary embodiment of a nozzle insert.
Figure 4:
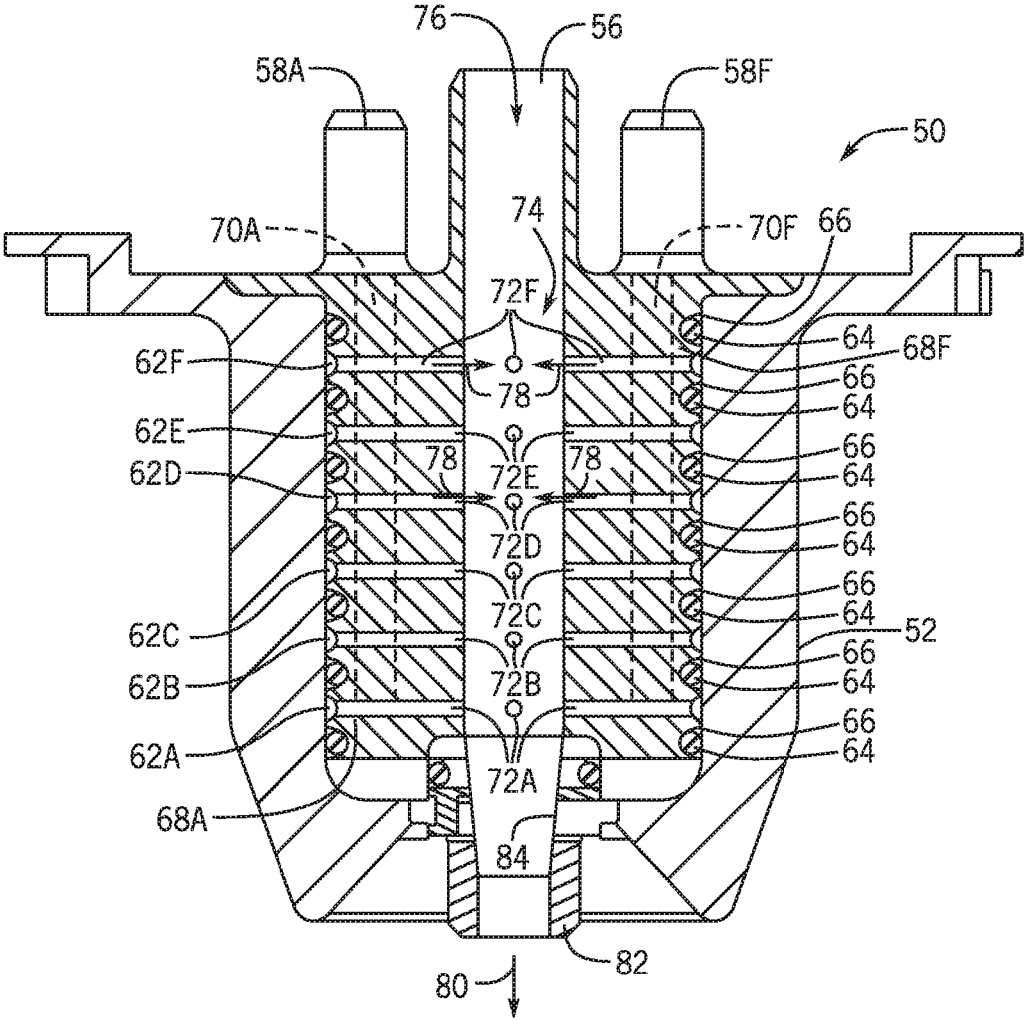
FIG. 4 is a cross-sectional view of the nozzle of FIG. 2 taken along line 4-4.

FIG. 3 depicts an exemplary embodiment of the nozzle insert 54. FIG. 4 is a cross sectional view of the nozzle 50, taken along line 4-4 of FIG. 3. FIGS. 3 and 4 both show the nozzle insert 54 in further detail. In FIG. 3, the flavoring inlets 58 have been identified as flavoring inlets 58A-F as each flavoring inlet exemplarily is used to receive a different flavoring and direct it through the nozzle to mix with a base substance for the dispense of a custom edible substance (e.g. a food or a beverage). As provided by the nozzle insert 54, each of the flavorings is directed through the respective flavoring inlet 58A-F into a flavoring channel 62A-F. The flavoring channels 62A-F are exemplarily annular channels formed in an exterior of the nozzle insert 54. The flavoring channels 62A-F are exemplarily separated by elastomeric seals 64, which may exemplarily be O-rings or other gaskets. The elastomeric seals 64 may exemplarily reside in separation grooves 66 between each of the flavoring channels 62A-F. The separation grooves 66 serve both to locate the elastomeric seals 64, to define the respective flavoring channels 62 A-F, and to retain the elastomeric seals 64 in position. As shown in FIG. 4, the elastomeric seals 64 press against an inner wall of the nozzle sleeve 52 to define each flavoring channel 62A-F apart from the other flavoring channels 62A-F.

Figure 5:
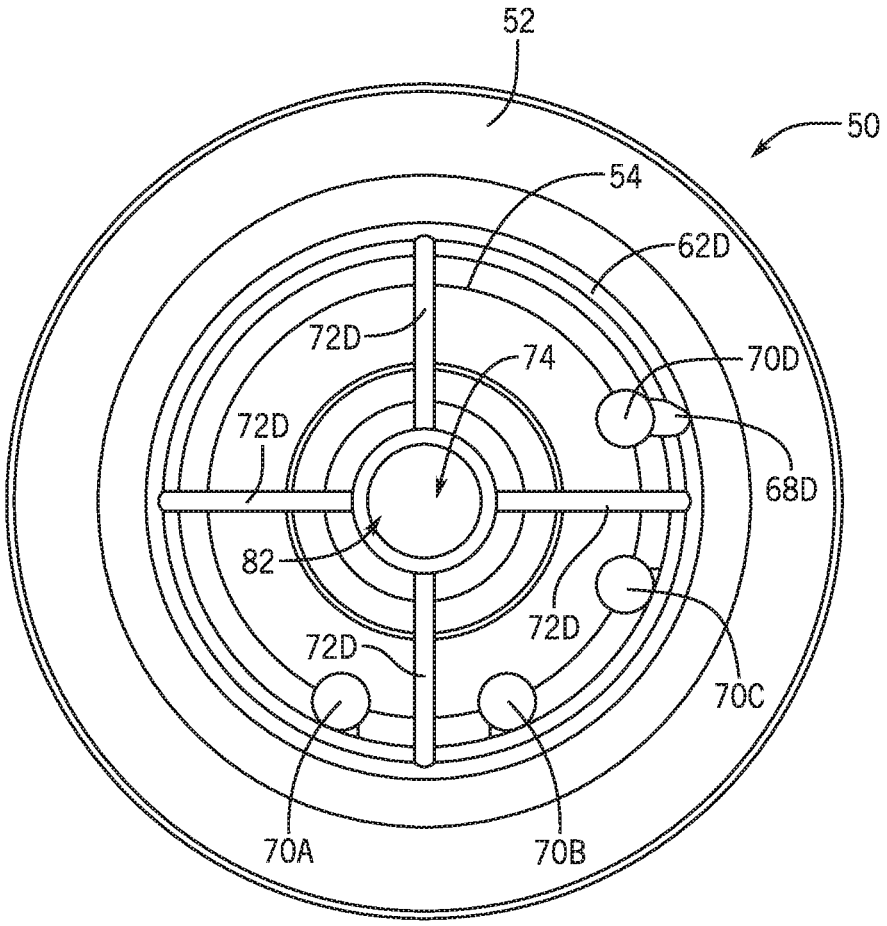
FIG. 5 is a cross-sectional view of the nozzle of FIG. 2 taken along line 5-5.

FIG. 5 is a cross-sectional view of the nozzle 50 as taken along line 5-5 of FIG. 2. As shown in FIGS. 4 and 5, a plurality of flavoring tubes 70A-F extend through respective flavoring inlets 58 and through the body of the nozzle insert 54 to a respective flavoring opening 68A-F located in the flavoring channel 62A-F for each flavoring. When a particular flavoring is to be used in mixing a custom food or beverage, it enters the nozzle 50 through the flavoring inlet 58 and down a respective flavoring tube 70 through the opening 68 into the flavoring channel 62. In the flavoring channel 62, the flavoring fills the channel 62 encircling the nozzle insert 54 within the respective flavoring channel 62. From the flavoring channel 62, the flavoring flows through passageways 72 (respectively 72A-72F) into a base chamber 74 of the nozzle 50 that contains the flow of base substance. The flows of flavoring substance mix with the flow of the base substance in the base chamber 74. In an exemplary embodiment, the passageways 72 extend radially inwards from the flavoring channel 62 to the base chamber 74 at the interior of the nozzle insert 54, within the nozzle sleeve. In an embodiment, the base chamber 74 is located along a central axis of the nozzle insert 54. In an exemplary embodiment, a plurality of passageways 72 are associated with each flavoring channel 62. In the exemplary embodiment depicted, four passageways 72 extend from each respective flavoring channels 62A-F and the passageways 72 are evenly spaced around the nozzle insert 54, exemplarily at 90 degree angles from one another. It will be recognized that other embodiments may include more or fewer passageways and such passageways need not necessarily be evenly distributed about the nozzle insert.

Other configurations of the nozzle insert 54 may be used while remaining within the scope of the present disclosure. The passageways 72 may exemplarily extend into the base chamber 74, for example in the form of a tube or a projection (not depicted). This is done to inject the flavor streams further into the flow of base substance for example to create or to conceal a striping effect from the flavoring substance or to improve shear mixing of the flavor with the base since the base substance will wrap around the flavor streams as the whole stream approaches the exit of the nozzle. In yet another configuration, the passageways 72 may open to the base chamber 74 at an angle other than radially towards the axis of the base chamber 74. For example, the passageways 72 may enter in a non-radial orientation relative to the central axis of a bore of the base chamber 74. In one example, the passageways 72 may enter tangentially to the base chamber 74. This may improve mixing by increasing the initial surface area of the flavor stream in contact with the base stream. This may also cause a visual spiraling effect if the jet of flavor substance has an appropriate fluid momentum to curve around the walls of the mixing chamber 74 within the flow of the base substance.

In a still further embodiment, similar to the way in which the flavoring openings 68 may be staggered in their connection to the flavoring channels, the passageways 72 may be staggered in the position at which they enter the axis base chamber 74. Each set of flavoring passageways 72 may be staggered angularly from the set of passageways upstream as this may help to protect the openings of the passageways 72 from being clogged by the upstream flavor. In still further embodiments, the base chamber 74 may increase in cross-sectional diameter at a position below each set of passageways 72. This may also provide further protection of the openings of the passageways 72 since the base flow will wholly or partially envelop an upstream flavor stream before the combined flow moves past the next downstream set of passageway openings. This effect may further be enhanced by shaping the base chamber 74 to contain cavities between flavor orifices, which would create space for the base to flow around and envelop a flavor stream.

As best shown in FIG. 4, a flow of a base 76 mixes with a respective flow 78 of flavoring within the base chamber 74 to produce the custom substance 80. The custom substance 80 is dispensed out of the nozzle 50 through an outlet 82 at an end of the nozzle insert 54. The outlet 82 is located generally opposite at least one of the base inlet 56 and flavoring inlets 58. Exemplary embodiments of the nozzle 50 facilitate mixing flow of the base 76 and the at least one flavoring 78 in at least three ways. First, the flow of the flavoring 78 through the respective passageways 72 produces jets of the flow of flavoring 78 which project the flavoring 78 into the interior of the flow of base 76. In an embodiment, the cross-sectional area of the openings of all of the passageways 72 of a set of passageways may be designed relative to the cross-sectional area of the respective flavoring inlet 58 and/or flavoring tube 70. The speed of the flavoring out of the passageways may be increased or decreased relative to the speed of the flavoring at the inlet 58 by increasing or decreasing the cross-sectional area of the passageways 72. Next, the plurality of passageways are inwardly directed to the base chamber 74 and project all of the flows of flavoring 78 into the middle of the flow of the base 76. As previously described, this facilitates sheer mixing of the base with one or more flavorings. Additionally, a taper 84 restricts of the flow of the combined custom substance 80. As the volumetric flow rate of the constituent base and flavorings remains constant or nearly constant, the restriction of the taper 84 increases the velocity of the combined custom substance 80 which further increases the mixing of the constituent components.

Figure 6:
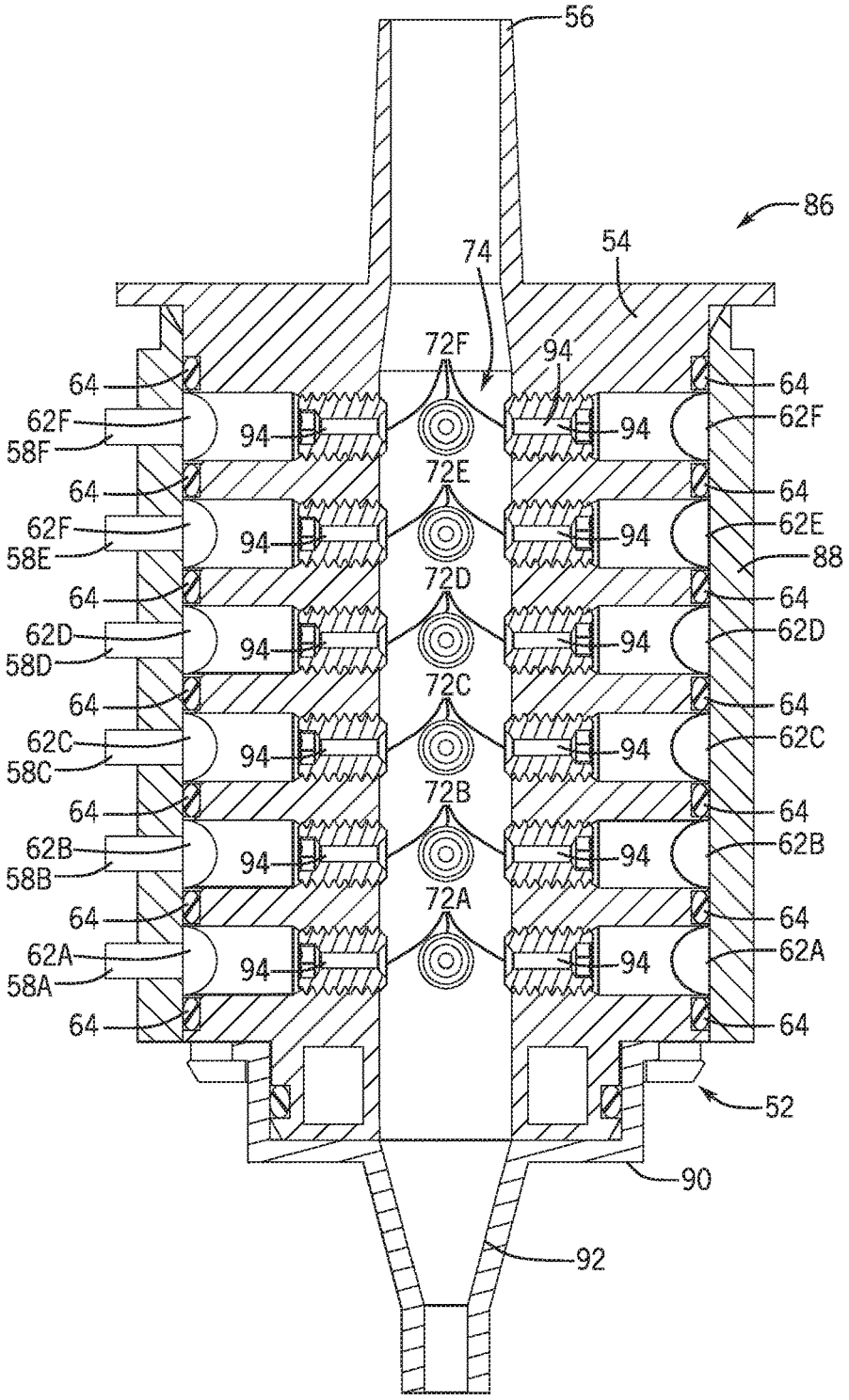
FIG. 6 is a cross-sectional front view of another exemplary embodiment of a nozzle.

FIG. 6 is a cross-sectional front view of another exemplary embodiment of a nozzle 86. It will be recognized that like reference numerals are used herein to reference similar structures in the following descriptions of additionally embodiments of nozzles, although a person of ordinary skill in the art will recognize that still further embodiments consistent with the disclosure provided herein can be formed by the combined teaching of the disclosed exemplary embodiments.

In the nozzle 86 depicted in FIG. 6, the nozzle sleeve 52 is exemplarily constructed in two pieces including a sleeve tube 88 and a sleeve cap 90. The nozzle insert 54 is received within the combined sleeve tube 88 and sleeve cap 90 of the nozzle sleeve 52. Additionally, the sleeve cap 90 includes a taper 92 as opposed to the nozzle insert 54, as described above. The taper 92 of the sleeve cap 90 exemplarily functions in the same manner as the taper 84 described above with respect to FIGS. 3-5.

Additionally, the passageways 72A-F further include inserts 94. In exemplary embodiments, the inserts 94 may exemplarily be metal inserts which may further help to define the passageways 72. In non-limiting examples, the inserts 94 may define orifices of a particular diameter for the interface between the passageway 72 and the base chamber 74. In still further exemplary embodiments, the inserts 94 may be check valves or bust valves that limit the flow of flavoring when a particular flavoring is not being used in the present custom dispense.

The nozzle 86 further exemplarily depicts an embodiment wherein the flavoring inlets 58 are provided from the side, extending through the nozzle sleeve 52 and more specifically through the sleeve tube 88 of the nozzle sleeve 52 and connected directly to the respective flavoring channels 62A-F.

Figure 7:
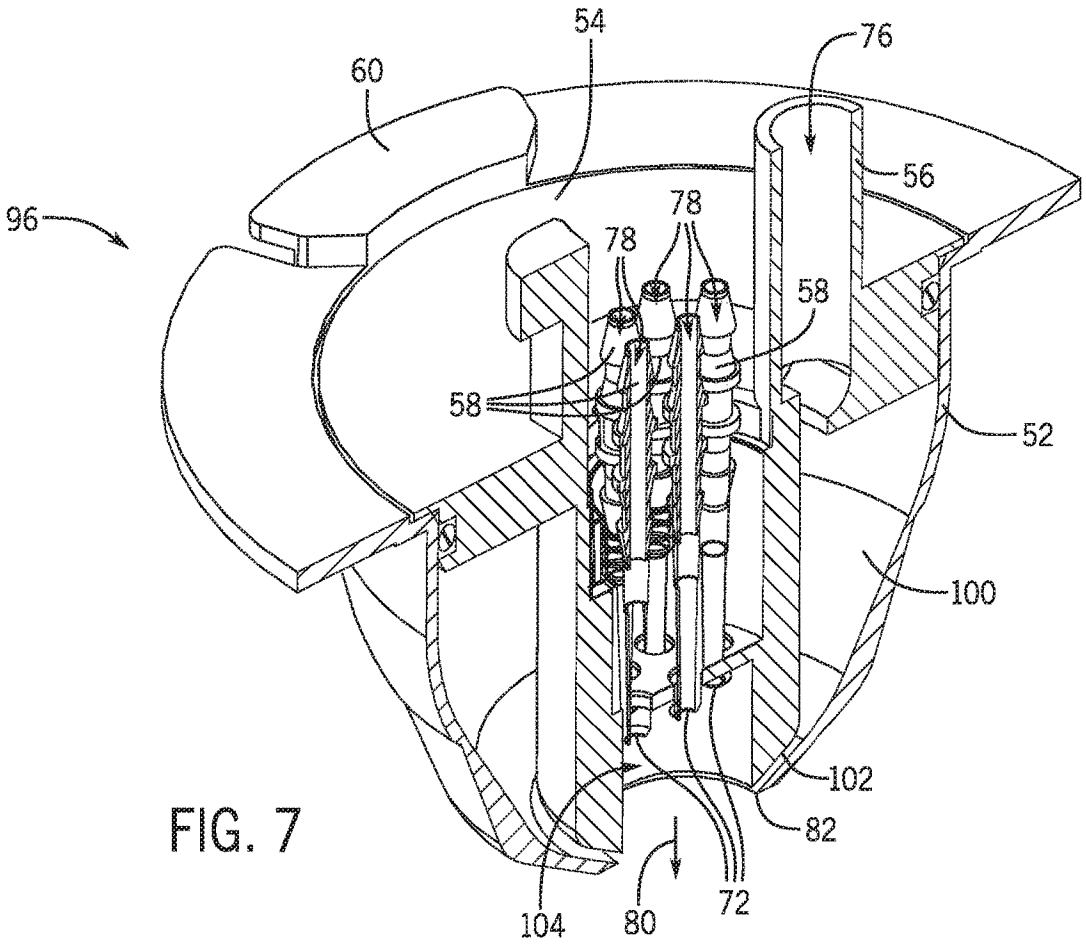
FIG. 7 is a cross-sectional perspective view of a further exemplary embodiment of a nozzle.
Figure 8:
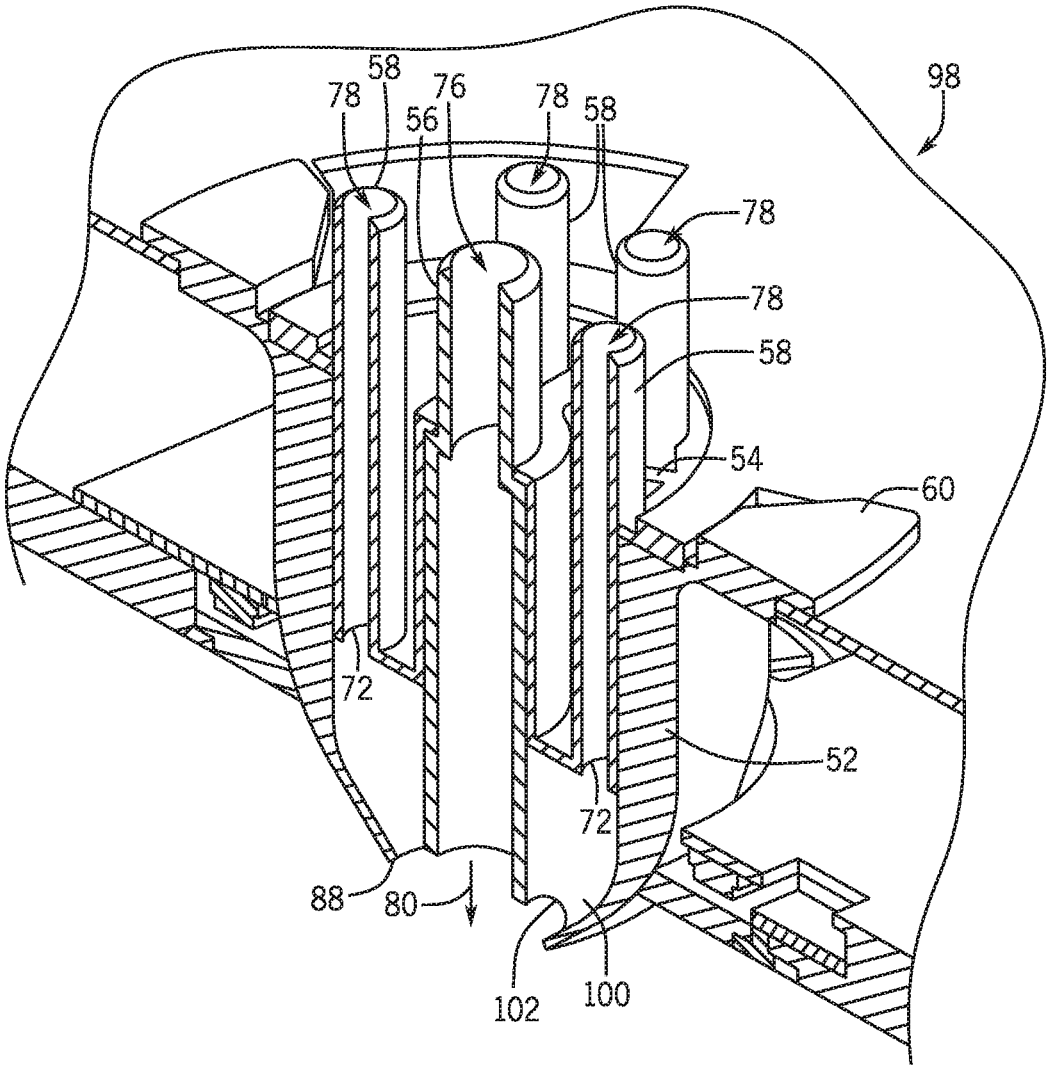
FIG. 8 is a cross-sectional perspective view a still further exemplary embodiment of a nozzle.

FIGS. 7 and 8 depict cross-sectional perspective views of additional exemplary embodiments of nozzles as may be used to dispense custom substances as described herein. FIGS. 7 and 8 are similar in that in both embodiments, the base and flavoring are mixed by laminar mixing as well as by impact between the flows of the base and flavoring within the receptacle into which the custom food/beverage is dispensed. The nozzle 96 depicted in FIG. 7 surrounds the flow of flavoring(s) 78 with a laminar flow of the base 76. The nozzle 98 depicted in FIG. 8 surrounds the flow of base 76 with a laminar flow of the flavoring(s) 78.

The nozzle 96 of FIG. 7 receives the flow of base 76 through the base inlet 56 and receives the flow of flavorings 78 through respective flavoring inlets 58 located in the nozzle insert 54. The flavoring inlets 58 are located radially interior of the base inlet 58, exemplarily along a center axis of the nozzle insert 54. The flow of base 76 is received through the base inlet 58 into a base chamber 100 defined between the nozzle sleeve 52 and the nozzle insert 54 and flows within the base chamber 100 around the nozzle insert 54. The nozzle sleeve 52 and the nozzle insert 54 are respectively tapered at a lower end to form an annular restriction 102. The flow of base 76 fills or partially fills the base chamber 100 and flows out of the nozzle outlet 82 in an annular sheet. In an exemplary embodiment, the base chamber 100 may be "primed" or filled and/or partially filled with the base substance prior to a dispenser of the custome substance.

Both the angle with respect to the flavor injection axis and size of the annular orifice have an effect on the appearance and mixing of the dispensed substance, and as such the flavor injection axis at annular restriction 102 of the outlet 82 and.or the diameter of the nozzle outlet 82 may be differently dimensioned depending on the rheological properties of the custom substance to be dispensed. In exemplary embodiments, the orifice size is minimized to increase speed of the constituent components of the custom dispense. In embodiments, a smaller orifice size has also been found to also function to smooth pulsation from the pumping system. However, it will be noted that too much restriction in the orifice may result in a pressure drop that effects the quality of the output custom substance or restricts the flow rate below what is desired. If the outlet 82 and/or the annular restriction 102 are too small and the food is optically translucent, the user may also be able to see the flavors through the annular sheet, which may be undesired. There may be an optimal outlet 82 and/or annular restriction 102 size for each type of food dispensed. Angle of the annular restriction 102 where the annular sheet of base substance exits the base chamber 100 is also important because depending on the exit speed of the orifice, the annular sheet may or may not be able to converge onto the flavor streams. Sizing the angle towards being perpendicular to the stream of flavors helps increase sheer mixing with flavors, but is less stable in maintaining a sheet of flow. Decreasing the angle creates a stable sheet, but such annular sheet of substance may not converge and decrease the amount of shear mixing. Thus, there may be an optimal angle depending on the rheological properties of the substance dispensed.

The flow of flavoring 78 is provided through the passageways 72 into an interior of the annular sheet of base produced by the annular restriction 102. The interface between the annular sheet of base substance and the flow of flavoring 78 causes shear mixing between the constituent substances, but also creates a dispense of the custom substance with a uniform appearance of the annular sheet of base. The passageways 72 are exemplarily spaced apart from the nozzle outlet 82 and the annular restriction 102. The nozzle insert 54 exemplarily comprises a flavoring chamber 104 to provide this space. In embodiments, the flavoring chamber 104 can exemplarily provide a space for any buildup of flavoring and/or base to extend for example due to backpressure from the merging of multiple flows of constituent base/flavorings at the nozzle outlet 82. This space can accommodate any back-up of the flavoring and/or base to prevent contact with the passageways 72. This helps to keep the passageways 72 clean, clear from obstruction, and avoids carryover/flavoring contamination. In exemplary embodiments, the nozzle opening 82 may extend radially interior of the nozzle insert opening/flavoring chamber 104 to create a taper to further facilitate mixing between the base and flavoring(s).

FIG. 8 depicts an exemplary embodiment of a nozzle 98, similar to that of the nozzle 96, although the base inlet 56 and the flavoring inlets 58 are switched, with the base inlet 56 axially aligned with the nozzle insert 54.

It has been found that in some embodiments of available nozzles, the exit orifice of the nozzle is vulnerable to atmosphere. If there is a duration of time in which no substances are dispensed from the dispenser, then the substances, and substance residues within the nozzle may begin to skin over, either clogging the nozzle after an extreme period of time, or producing an undesirable texture on the next dispense. Therefore, in embodiments features may be incorporated to seal the nozzle exit so that the exit orifice will only be exposed to atmosphere during dispense, thus protecting the substances in the nozzle from drying, as well as providing a mechanical barrier to prevent post dripping after dispenses.

Figure 9:
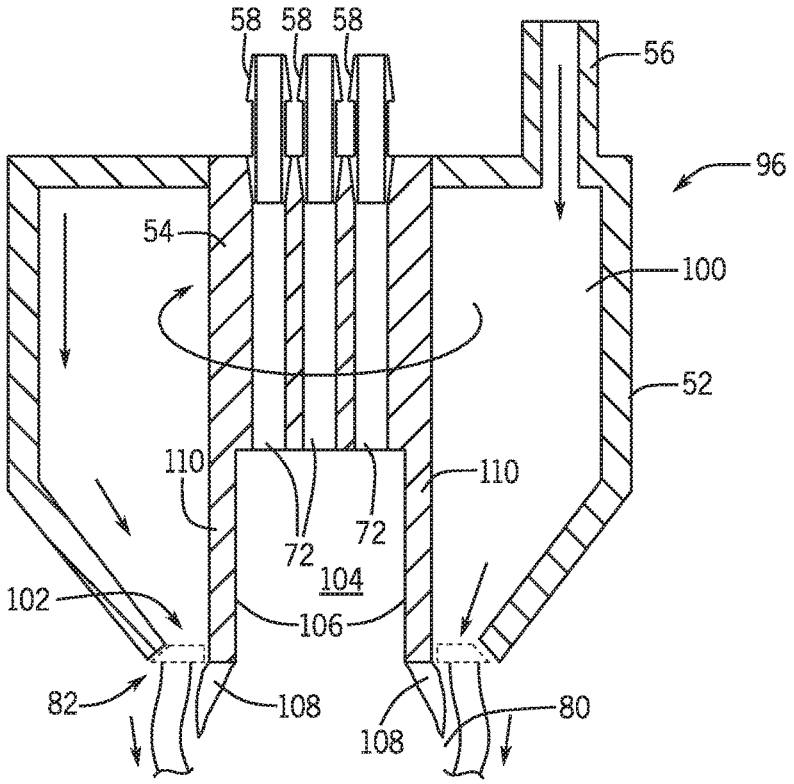
FIG. 9 is a sectional view of an exemplary embodiment of a nozzle.

One solution is to use one or more elastomeric valves incorporated with the nozzle. FIG. 9 depicts an embodiment of a nozzle 96, for example as depicted and described above with respect to FIG. 7. The nozzle 96 includes an umbrella-type elastomer seal 106 that surrounds the flavoring passageways 72. The elastomer seal 106 includes an annular flap 108 that releasably covers the annular restriction 102 at the nozzle outlet 82. The annular flap 108 is shown in a closed position in dashed lines, while in solid lines is shown in a position where the flow of base substance pushes the annular flap 108 out of the way. When the flow of base substance stops, the resiliency of the annular flap 108 returns the annular flap 108 to the closed position.

Tight dimensions and assembly enables the annular flap 108 to seal against a certain hydrostatic pressure from base substance remaining in the base chamber 100 of the nozzle 96 as shown in dashed lines. When sufficient pressure of the base substance is applied by the pumping system, the pressure flexes the annular flap 108 to the position shown in solid lines and allows flow through the nozzle outlet 82 in an annular sheet, still functioning as previously described. In an embodiment, some or all of the nozzle insert 54 may be constructed of the same elastomeric material as the annular flaps 108. In a still further embodiment, the elastomer seal 106 may comprise insert walls 110 also constructed of the same elastomeric material. The insert walls 110 may serve to help define the base chamber and the flavoring chamber 104 while providing additional flexibility to the elastomeric seal 106 such that the flow of base substance works to flex the insert walls 110 inwards as well to facilitate opening of the elastomeric seal 106.

Figure 10:
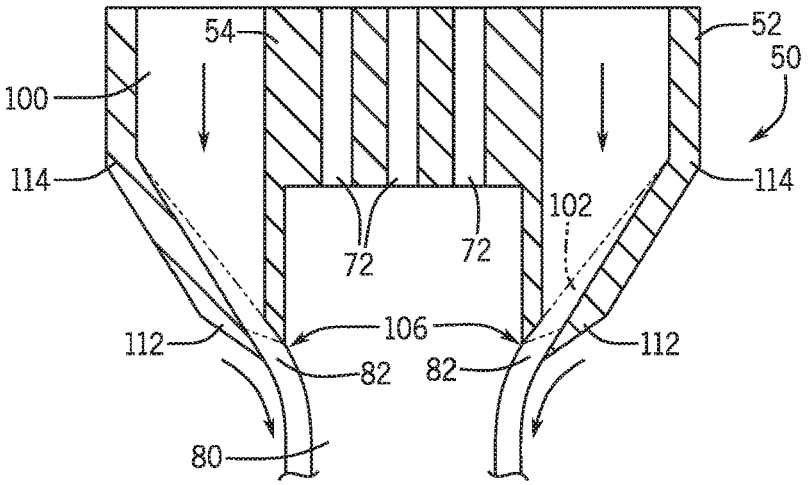
FIG. 10 is a sectional view of another exemplary embodiment of a nozzle.
Figure 11:
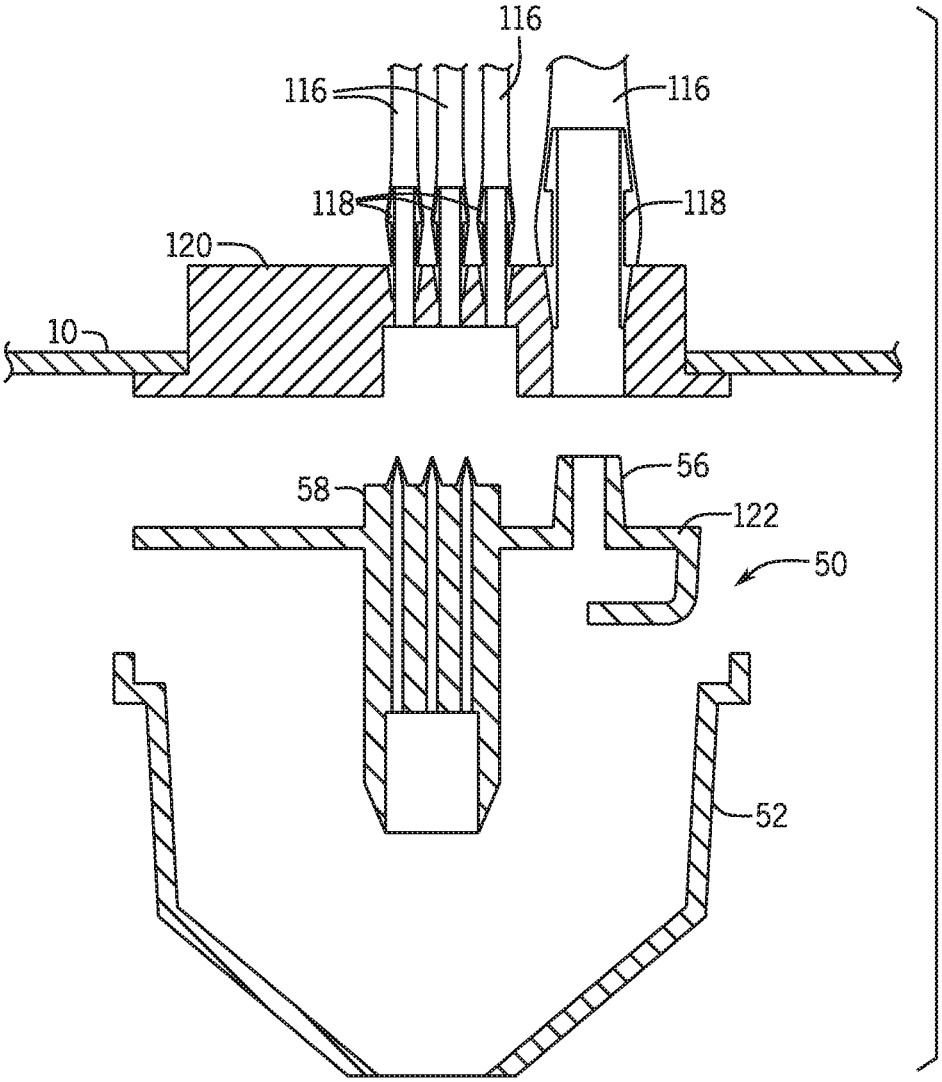
FIG. 11 is a sectional view of a further exemplary embodiment of a nozzle.

In the embodiment depicted in FIG. 10, the nozzle sleeve 52 may instead provide the seal to close the base chamber 100 from dripping and exposure to atmosphere. In an exemplary embodiment some or all of the nozzle sleeve 52 is constructed with a flexible elastomeric material. Resilient flexibility of the nozzle sleeve 52 may therefore provide the elastomeric seal 106. As provided in FIG. 10, in FIG. 11, the closed position of the elastomeric seal 106 is provided in dashed lines and the open position of the elastomeric seal 106 is provided in solid lines. In the embodiment depicted in FIG. 10, the insert walls 100 may exemplarily be rigid in construction. In an embodiment, this facilitates sealing of a portion of the nozzle sleeve 52 against the insert walls 110.

In an exemplary embodiment, the nozzle sleeve 52 includes an annular ring 112 of elastomeric material at the nozzle opening 82. In this manner, only the portion of the annular ring 112 may flex to open the nozzle opening under the pressure of the base substance being dispensed. Otherwise, the annular ring 112 is biased against the insert wall 110. In another exemplary embodiment, the nozzle sleeve 52 may include an elastomeric elbow 114 about which a portion of the nozzle sleeve 52 flexes to open the nozzle opening 82. In a still further embodiment, the entire nozzle sleeve 52 may be constructed of elastomeric material such as to flex under the sufficient pressure from the pumped base substance during a dispense. In each of these embodiments, the resilient nature of the elastomeric portions of the nozzle sleeve 52 returns the nozzle sleeve 52 to a position closing off the base chamber 100 when the dispense is finished. It will be recognized that the embodiments shown and described herein with respect to FIGS. 9 and 10 can further function as pulsation dampers and flow controls which may further improve the mixing and quality of the dispensed custom substance.

In exemplary embodiments, the nozzles 96 are configured in a manner such as to facilitate connection and removal from the dispenser machine. Improved connection and removal of the nozzles, can facilitate cleaning of the dispenser and the nozzles, for example as the nozzles likely will require more frequently exchange and/or hand cleaning compared to other components of the dispenser, particularly those that do not contact food or consumables. The nozzles may interface with the dispenser and flexible tubes of flavoring substance and base substance in a variety of ways, depending on commercial availability of materials, ease of assembly and disassembly, and ease of cleaning. In one embodiment, exemplarily depicted in FIG. 11, a nozzle 96 constructed similarly to that as shown and described above with respect to FIG. 7 is connected to a dispenser 10. The flexible tubing 116 of the dispenser terminates on barb fittings 118 that friction fit into an elastomer base 120 which is connected to the dispenser 10. The elastomer base 120 can be retained on the dispenser 10 by the resiliency of the elastomer material of the base 120. In an embodiment, the elastomer base 120 is designed to remain in place during cleaning of the dispenser 10 and nozzles 96. The base passageways and/or the flavoring passageways may be connected with the nozzle insert 54 that friction fits into the elastomer base 120 and is secured by twist-locking the outer sleeve 52 onto a mount plate of the dispenser 10. In another embodiment, the interface to the flexible tubing which carries the base substance and the flavoring substances within the dispenser includes barb fittings.

Figure 12:
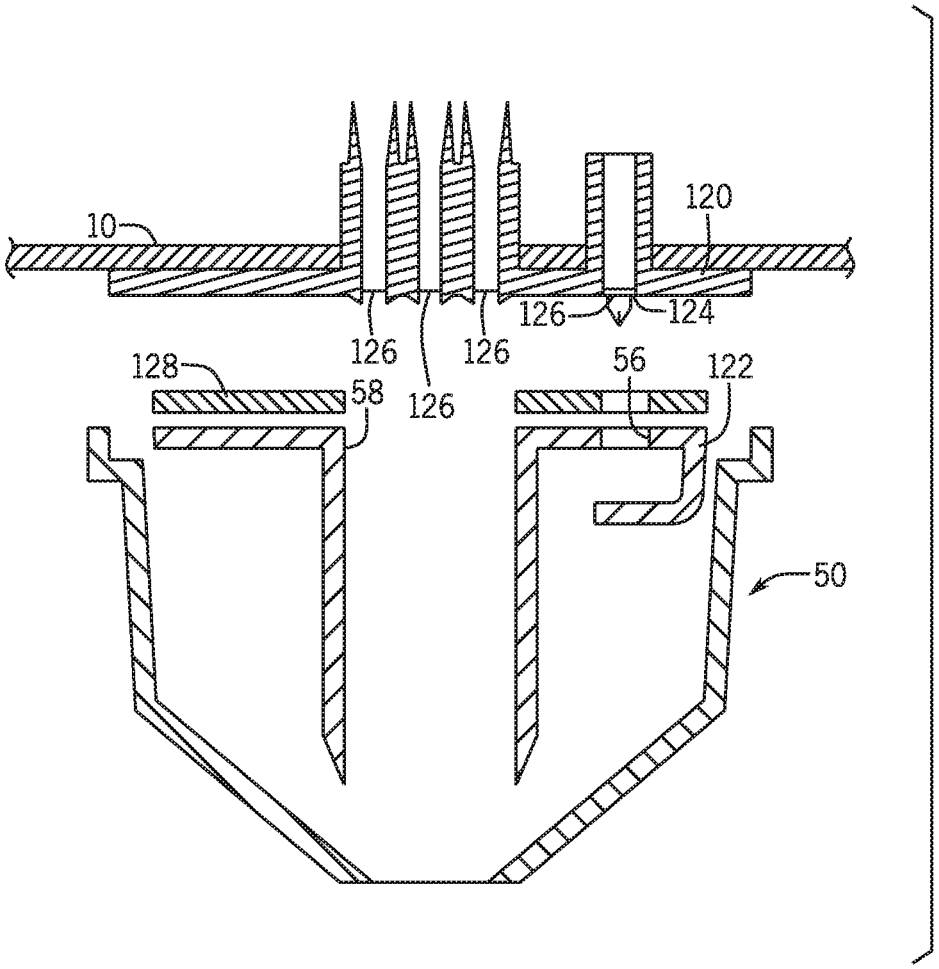
FIG. 12 is a section al view of a still further exemplary embodiment of a nozzle.

As depicted in FIG. 12, the elastomeric base 120 may include elastomeric or other types of check valves 124 on one or more of the outlets 126 to which the base passageway and the flavoring passageways connect to help protect the product, and retain the product within the dispenser during removal and cleaning of the nozzle 96. The nozzle insert 52 and nozzle sleeve 52 then interface directly with the rest of the dispenser 10. A diffuser 122 can direct the flavors of flavoring substance through the passageways 72 into a flavoring chamber 104 defined b the nozzle insert 54. An elastomeric gasket 128, which may be a separate component or adhered/overmolded to other components can seal the pathways at the connection. The seal at the elastomeric gasket 128 can be tightened by twist locking the nozzle 50 to the dispenser as described in embodiments above, or as will be recognized by a person of ordinary skill in the art from the present disclosure. Elastomeric check valves may be molded directly into the gasket.

Figure 13:
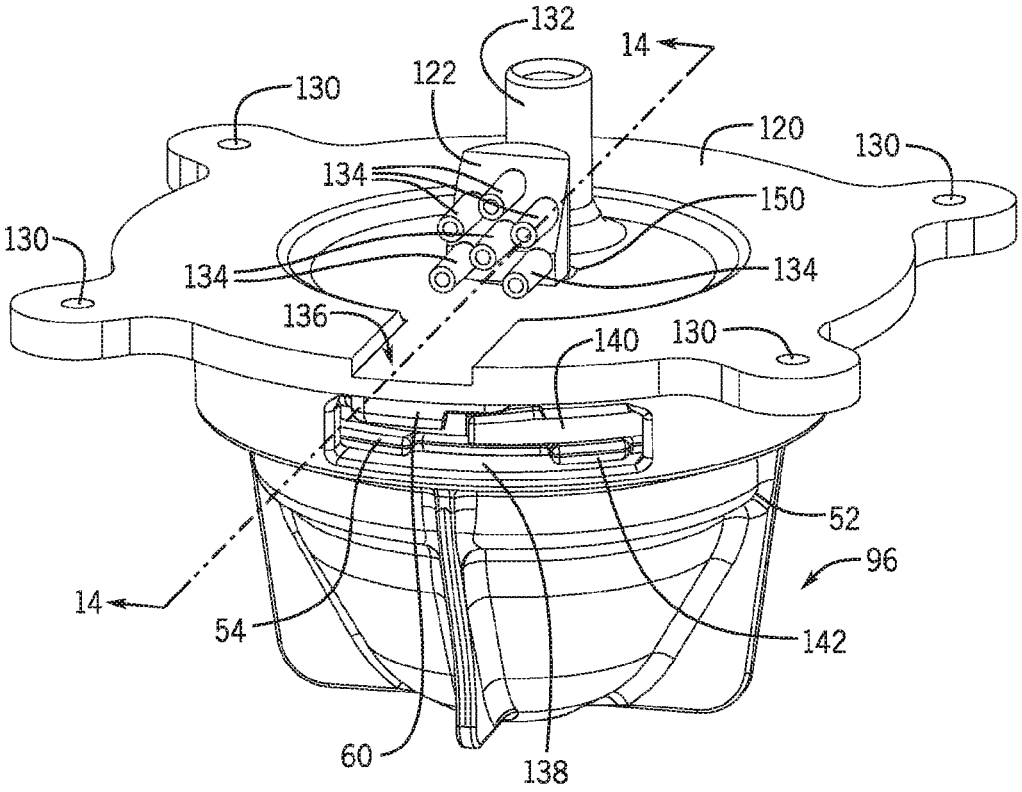
FIG. 13 is a perspective view of an exemplary embodiment of a nozzle and a mounting bracket.

FIG. 13 is a perspective view of a still further exemplary embodiment of a nozzle 96 connected to a mounting bracket 120. It will be recognized that the mounting bracket 120 is further secured to the dispenser (not depicted) exemplarily using fasteners (not depicted) through mounting holes 130. The mounting bracket 120 includes a base barb 132 which is configured to be connected to the flexible tube (not depicted) through which the base substance flows and is delivered to the nozzle 96. A flavoring substance diffuser 122 includes a plurality of flavoring barbs 134 which are configured to engage and be fluidly connected to flexible tubes (not depicted) through which the flavoring substance flows and is delivered to the nozzle 96 through the flavoring diffuser 122. The mounting bracket 120 includes a channel 136 which is exemplarily configured to provide a path for the flexible tubes connected to the flavoring bargs 134 to connect to the flavoring substance diffuser 122 in a space-efficient manner.

The nozzle 96 is exemplarily constructed of a nozzle sleeve 52 and a nozzle insert 54, for example as described with respect to other embodiments. The nozzle sleeve 52 exemplarily includes mounting features which for example comprise a tab 60 and a mounting ledge 138 which respectively engage portions of the mounting bracket 120, for example a mounting finger 140 of the mounting bracket 120 and one or more mounting tabs 142 of the nozzle insert 54. In the exemplary embodiment depicted in FIG. 13, the mounting tab 142 of the nozzle insert 54 fits into the nozzle sleeve 54 and rests on the mounting ledge 138. The mounting finger 140 of the mounting bracket 120 is resiliently received between the tab 60 of the nozzle sleeve 52 and the mounting tab 142 of the nozzle insert 54. This connection may for example be a twist frictional fit to secure the nozzle 96 to the mounting bracket 120.

Figure 14:
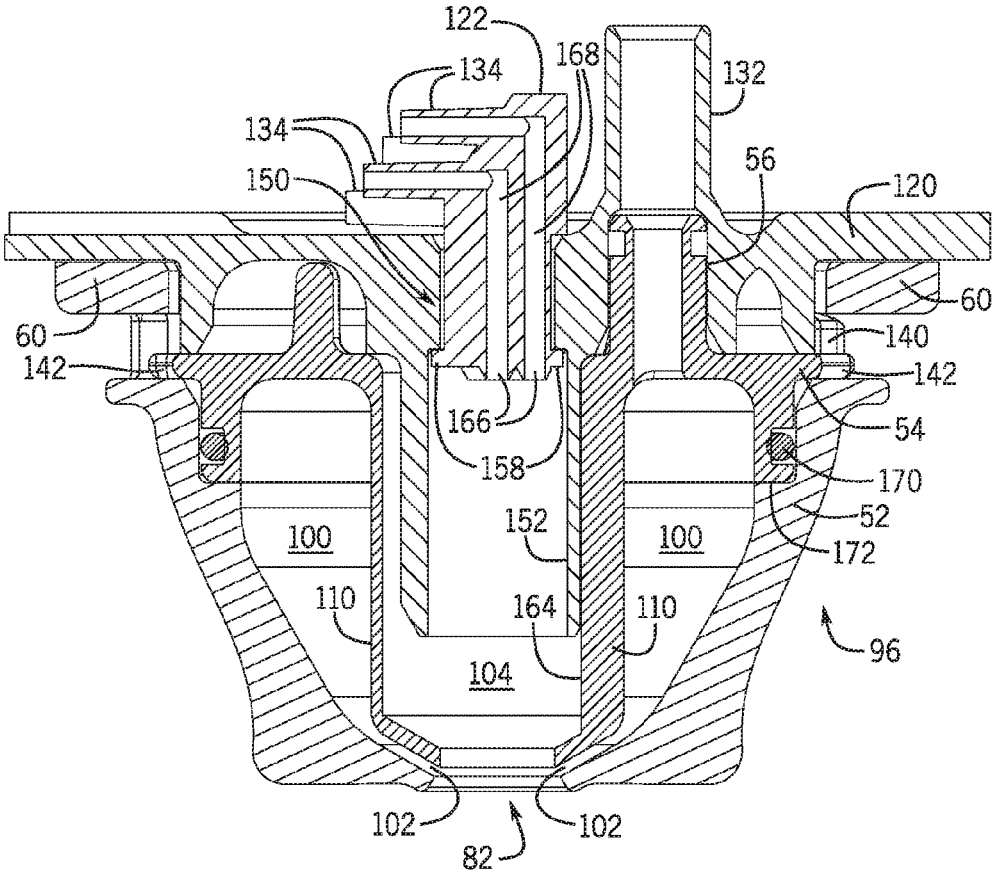
FIG. 14 is a sectional view taken along line 14-14 of FIG. 13.
Figure 15:
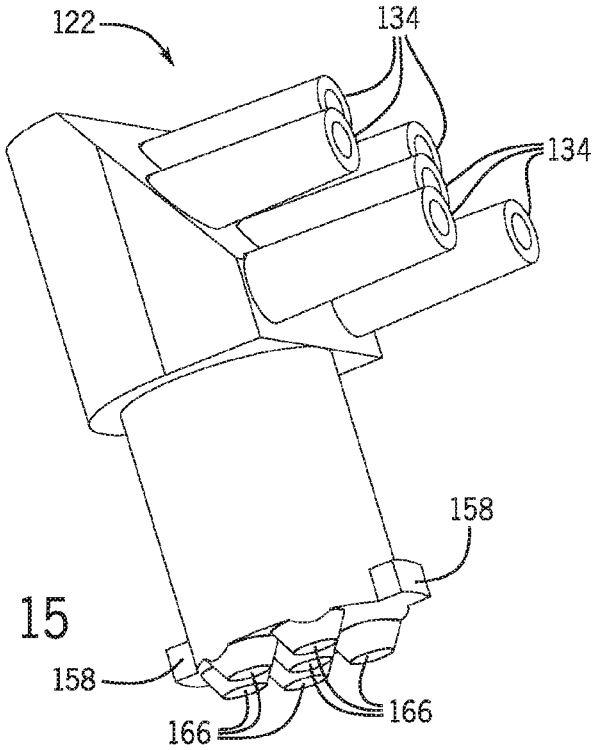
FIG. 15 is a perspective view of an exemplary embodiment of a flavoring substance diffuser.
Figure 16:
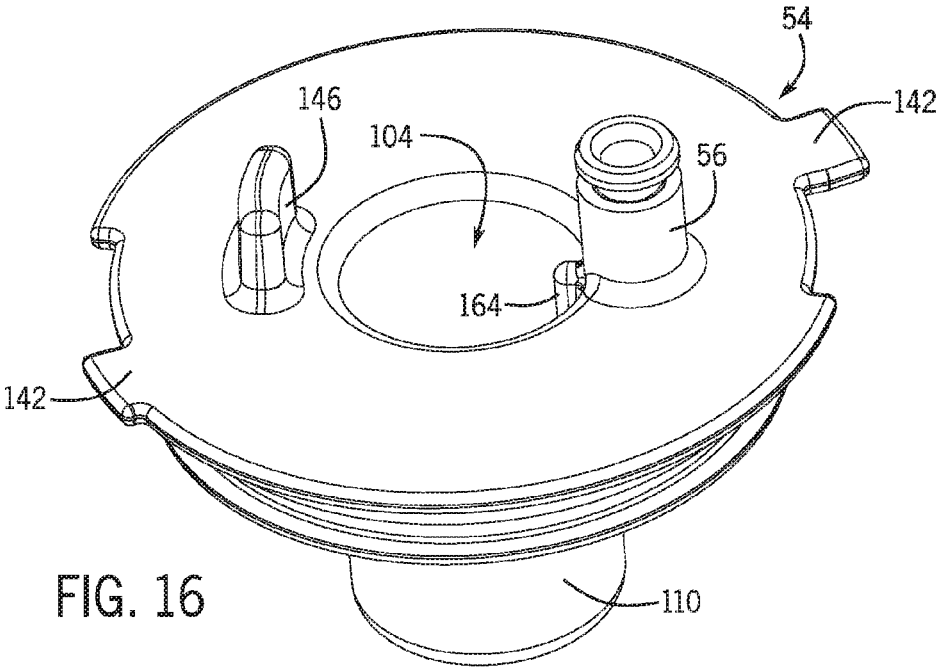
FIG. 16 is a perspective view of an exemplary embodiment of a nozzle insert.
Figure 17:
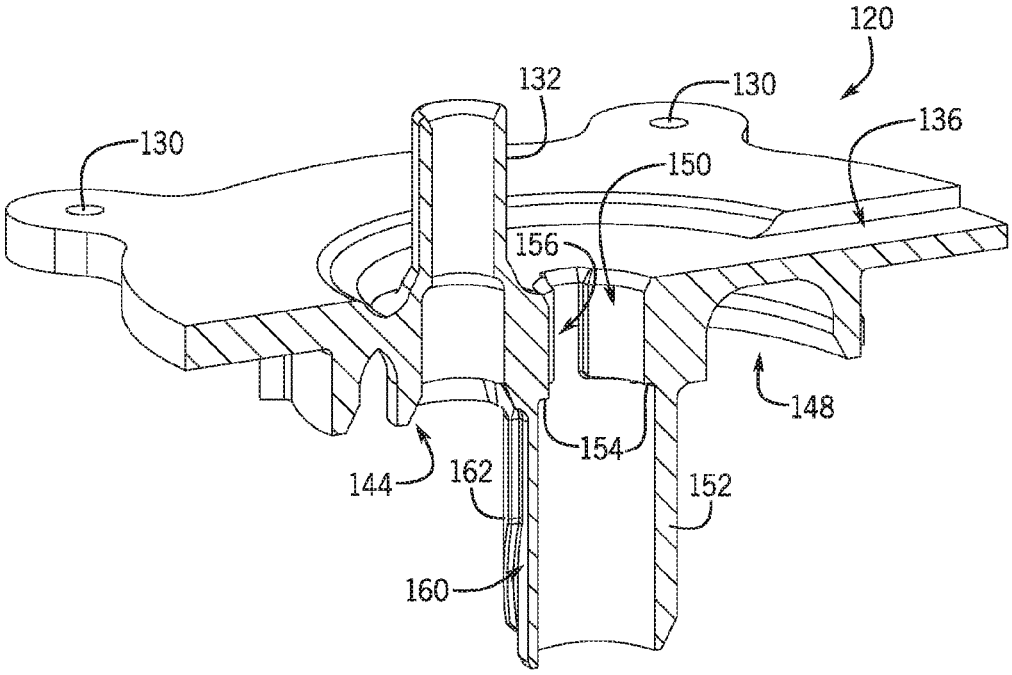
FIG. 17 is a perspective sectional view of a mounting bracket taken along line 14-14 of FIG. 13.

FIG. 14 is a cross sectional view of the nozzle 96 and mounting bracket 120 taken along line 14-14 of FIG. 13. FIG. 15 is a perspective view of an exemplary embodiment of a diffuser 122. FIG. 16 is a perspective view of an exemplary embodiment of nozzle insert 54. FIG. 17 is a perspective sectional view of the mounting bracket 120 taken along the same line 14-14 of FIG. 13. These Figures in combination depict the exemplary components of the nozzle 96 and mounting bracket 120 shown together in FIGS. 13 and 14.

As previously noted, the mounting bracket 120 is secured to the dispenser machine and forms the interface from which the nozzle 96 is secured and removed, for example for manual cleaning. The mounting bracket 120 exemplarily includes the base barb 132 to which the flexible tube (not depicted) through which the base substance is provided is secured. The mounting bracket 120 includes a base recess 144 located on and above the mounting bracket 120 in coaxial alignment with the base barb 132. The base inlet 56 of the nozzle insert 54 is received within the base recess 144 to provide fluid communication of the base substance through the base barb 132 and the base inlet 56 into the base chamber 100 formed between the nozzle insert 54 and the nozzle sleeve 52.

The nozzle insert 54 further includes a projection 146 that is received within a projection housing 148 defined into the mounting bracket 120. The alignment of and receipt of the projection 146 within the projection housing 148 helps to align the nozzle insert 54 relative to the mounting bracket 120 and helps to limit relative movement between the nozzle insert 54 and the mounting bracket 120. In this manner, the rotative movement of the nozzle sleeve 52 relative to both of the mounting bracket 120 and the nozzle insert 54 secures and releases the nozzle 96 from connection to the mounting bracket 120.

The mounting bracket 120 further includes an orifice 150 that is exemplarily aligned on a central axis of the mounting bracket 120. As shown in FIG. 14, the diffuser 122 is received within the orifice 150. A tube 152 extends downwards away from the orifice 150 and a mounting shoulder 154 is defined at a juncture of the orifice 150 with the tube 152. A recess 156 further extends through a wall of the orifice 150. As will be seen by reference to FIGS. 14 and 15, the diffuser 122 includes flanges 158 which, when aligned with recesses 156, permit insertion of the diffuser 122 into the orifice 150. Once the diffuser 122 is inserted, a rotational movement of the diffuser 122 rotates the flanges 158 into engagement with the shoulders 154 and out of alignment with the recesses 156. This removably secures the diffuser 122 to the mounting bracket 120.

Additionally, the tube 152 includes a channel 160 which may exemplarily be defined by one or more channel walls 162. A rib 164 is located within the flavoring chamber 104 along the center axis of the nozzle insert 54. The flavoring chamber 104 is exemplarily defined by the insert wall 110 which may exemplarily be angular in shape and extend downward from the top of the nozzle insert 54 into the interior of the nozzle sleeve 52. The exterior of the insert wall 110 and interior of the nozzle sleeve 52 defines the base chamber 100. Alignment of the channel 160 to receive the rib 164 locates the tube 152 of the mounting bracket 120 coaxially within the insert wall 110 defining the flavoring chamber 104. Thus, as shown in FIG. 14, this interlocking engagement between the diffuser 122, mounting bracket 120, and nozzle insert 54 locate the outlets 166 of the diffuser 122 with the outlet 82 of the nozzle 96. Thus, as the annular sheet of base substance are produced by the base substance exiting through the annular restriction 102 between the nozzle insert 54 and the nozzle sleeve 52, the flavoring is dispensed through the outlet 82 into the annular sheet of base substance that promotes a sheer mixing of the flavoring with the base substance while also concealing the flavoring within the annular sheet of the base substance.

The diffuser 122 further includes passageways 168 which connect the flavoring bars 134 to the outlets 166 to distribute the flavoring substance thereto. Additionally, an elastomeric seal 170, exemplarily an o-ring, is located between the nozzle insert 54 and the nozzle 52 to further create a fluid tight seal therebetween in a manner further defining the base chamber 100. It will be recognized that in exemplary embodiments, at least part of the elastomeric seal 170 may be retained within an annular groove 172 which facilities locate of the elastomeric seal 170 relative to the nozzle insert 54 and the nozzle sleeve 52.

It will be recognized that embodiments of the combination of the nozzle 96 and the mounting bracket 120 as described above may facilitate cleaning and maintenance of the nozzle 96 and/or the dispenser as a whole. In an exemplary embodiment, the nozzle 96 can be removed from the dispenser without requiring disconnection of the flexible tubes that carry the base substance and/or the flavoring substances to the nozzle. Additionally, the mounting bracket 120 may provide a mounting point or structure to which a cleaning device may be secured in order to circulate cleaning solution through the mounting bracket 120 to the flexible tubes (not depicted) for in place cleaning of the dispense itself.

In a still further embodiment, the interface between the dispenser and the inner nozzle consists of ports sealed by o-rings. The female or male side of the connection may be provided by either the dispenser side or the nozzle side, or a combination of both connection types may be provided on each component. In an exemplary embodiment, the flexible tubes of the flavoring substance and the base substance may be connected to the nozzle through an elastomeric fitting. The flavoring substance tubes may terminate in barb fittings that friction fit with the elastomeric fitting, and the elastomeric fitting is overmolded, adhered, or friction fitted into the dispenser. Then the nozzle is secured to the combined dispenser and fitting. The exit orifices of the dispenser may be protected by check valves. The nozzle assembly is held in place via twist lock. In another embodiment, the dispenser interfaces with the nozzle via o-rings and the flavoring substance tubes fit onto barbs designed into the nozzle.

It may be desired to have the ability to clean the system using drain tubes or cleaning heads that interface with either the nozzle or with the unit after the nozzles removed. In one such exemplary embodiment, the base that interfaces with the tubing of the system also has a collar that extends down to external cladding of the dispenser to protect the inside of the dispenser from any dripping during the cleaning procedure. The nozzle may twist lock into the base as previously described, but the cleaning head may lock into the base via a snap fit. In such an embodiment this may aid placement of several cleaning heads since the cleaning heads may branch off from a single cleaning line and thus be difficult to twist. The nozzle may have similar snap fit retention features so that the nozzle and the cleaning head can secure to the dispenser in the same manner. The base may have guiding tracks to help guide the nozzle into the twist lock or snap fit features. The collar on the base may also safely allow the user to spray cleaning fluid up inside to the base and wipe down.

Depending in part upon the rheological properties of the substances being dispensed, further exemplary embodiments of nozzles as disclosed and described herein my use further structures and techniques to facilitate mixing of the base substances and flavoring substances.

In an exemplary embodiment, a nozzle tip may interrupt the flow of the custom substance with a plurality of orifices placed concentrically within the flow path of the custom substance. These orifices may exemplarily be formed by a plurality of radially extending spokes. After the custom substance passes through these orifices the flow of custom substance re-converges to a small orifice and exits to atmosphere, which may result in improved shear mixing. This re-convergence may help mixing even more if the orifices surrounding the body are of different sizes, thus creating different velocity streams to shear against each other.

In another exemplary embodiment, the nozzle may include a static mixer that behaves as a stream separator. The flavor and base streams can be divided by a series of radial protrusions for a length, and then divided by another series of protrusions at a different angle with respect to the axis of flow. Multiple stages of protrusions can be arranged within the flow path. Re-convergence after separation may create a greater mixing effect than allowing the stream to run through an unobstructed pathway. In another example, the protrusions may be shaped to allow the flavoring substance to be routed over a flow of base substance so that the separated flow of flavoring substance can be wholly or partially enveloped by the flow of base sub stance.

The flows of flavoring substances could further be introduced into the flow of base substance in a direction normal to the axis of the base substance flow, or in-line with the axis of base substance flow, depending on what is more compatible with a reducer, static mixer, or if striping effects are desired. When introducing the flavoring substances in line to the base substance flow, embodiments may further be arranged to increase the surface area of the flavoring substances as much as possible to increase shear mixing between the flavoring substances and the base substance. In an embodiment, axial entry of the flavoring substances may be provided by flavoring orifices which are shaped narrow and long to create a flat sheet of flavoring substances that enters the flow of base substance. In a still further embodiment, the flavoring orifices can be divided into a plurality of flavoring orifices which diffuse the flavoring into the flow of base substance. In an exemplary embodiment, each flow of flavoring substance may be divided into three separate streams of the flavoring substance that exit at different angles from each other, not just normal to the axis of base substance flow. The orifices also exit at an angle to further increase surface area of the exiting streams and create a sheet-like stream of flavoring substances.

It is possible that designs similar to traditional or standard static mixers may be used if the fluids are sufficiently immiscible or viscous. However, in exemplary embodiments, the pumping systems used in dispensers as disclosed herein may be limited in the pressure that the pumps are capable of producing or the dispenser system is configured to operate at pressures lower than the pressure drops typically required by conventional static mixers. Conventional static mixers are typically used on an industrial scale or with a hydraulic piston powered by hand in the case of epoxy mixers. Thus, modifications to static mixer designs are needed if such an approach is to be incorporated into a nozzle for the mixing of custom substances for consumption, for example custom condiments. Non-limiting and merely exemplary embodiments of modified static mixer solutions may include a helical type static mixer with cutouts in the elements to allow some flow through and to reduce pressure drop. In another embodiment, an X-type static mixer may include the x-bodies of the elements in contact with each other, creating very small orifices for the flavoring and base substances to travel through, thus causing a high pressure drop. In a further embodiment, the x-bodies are smaller and there are less x-elements dividing flow, which may reduce the required pressure drop.

In a still further example, the flavoring substances to be dispensed may be of particularly high concentration. These small volumes may be difficult to mix throughout the comparatively larger volume of the base substance all at once, or the flavoring substances may be difficult to post flush on high surface area mixing geometries. Therefore, the flow of base substance may be separated into two portioned (or more) streams of base substance. One stream pre-mixes with the flavoring substances before the streams of base substance are reintegrated and mixed together. In another example of this approach, the mixing of the streams of base substance happens at a point before the nozzle, and the base is divided amongst different mixing paths for each flavor that are delivered to the nozzle. The base substance may be divided by entering a manifold with different valve directing to chambers for integration with each of the requested flavoring substances in the custom order. In certain embodiments, combining the flavoring substances and the base substance at a sufficient upstream distance from the nozzle opening may provide enough mixing from friction at the tubing walls. In another embodiment where mixing occurs in separate portioned streams of the base substance with each of the dispensed flavoring substances, the flow of base substance may not be controlled by separate electromechanical valves. Instead, the flow of the requested flavoring substances may control the flow of the base substance into the active streams of flavoring substance. Inlets of base substance and flavoring substances may further be sealed with elastomeric valves as previously described above with respect to other nozzle embodiments. In such an embodiment, when a flow of a flavoring substance is occurring, the pressure from that flow opens a valve, for example an elastomeric umbrella valve, and allows the flow of base substance through. In such an embodiment, the opening pressure of the valve must be greater than the pressure of the flow of base substance during dispense so that it does not open when another flavor is being dispensed.

In some food applications, dynamic mixing may be required. In an embodiment, this dynamic mixing may include a rotating paddle that may be driven by a motor and sealed into the nozzle. The paddle may cause a swirling action that may be visually appealing, allowing the flavor to be visible as a swirl around the base. This may be particularly appealing in a dessert foods application.

One challenge to laminar mixing of foods is that while increased surface area of the interface between the base condiment and the flavorings enhances the shear mixing effect during the laminar flow, increased physical surfaces in the nozzle and increased complexity of the nozzle geometry can create spaces which are challenging to clean and keep clean making such geometries impractical for use in food processing. Still further challenges addressed by the nozzle 14 are that shear mixing occurs upon interaction of the substances in a laminar flow however, currently available geometries for nozzles to create such laminar flow do so at a high pressure drop. This high pressure drop and the resulting increase velocity causes shear thinning among many base condiments which are often fluid or semisolid foods which rheologically act as pseudo plastics or non-Newtonian fluids. Shear thinning while increasing mixing can degrade the consumer perceived quality of condiments and mouth feel of condiments. Therefore, geometries of nozzles may be used to exhibit a low pressure drop to maintain condiment quality. Additionally, due to the viscosity of the condiments, the practically achieved flow rates of the condiments may be low due to the qualities available pumps.

Another challenge in custom mixing and dispensing of a viscus or semi-viscus food is that of carryover of flavoring from a previous dispense into a subsequent dispense that uses different flavorings. Due to the relatively small volume as is contemplated to be dispensed, even a small amount of unrequested flavoring may negatively impact the taste and quality of the dispensed product. One cause of carryover is a Venturi effect created by the flow of base past one or more flavoring inlets which draws a flow of flavoring located in the flavoring inlet into the base as the base flows past. Another solution to carryover can be provided with further control of the dispensing process. In such a control, the dispense of the flow of the flavoring is ceased before the end of the dispense and instead a backpressure is created in the flavoring inlet which draws the base into the flavoring inlet which creates a "seal" of base to prevent flavoring from being drawn into the base chamber by the aforementioned Venturi effect. The Venturi effect may draw the base out of the flavoring inlet but carryover of the flavoring itself is limited or prevented. This back pressure may exemplarily be created by reversing the operation of the pump to create such back pressure or may be created by application of a vacuum (not depicted) to the flavoring inlet, exemplarily through the flavoring tube.

As mentioned above, while not limiting on the scope of the present disclosure, embodiments of the custom condiment dispenser are contemplated for dispense of small volumes of custom condiments. Three exemplary use cases exhibit the types of small volumes of custom condiments contemplated as opposed to other food processing solutions which use a bulk processing method for flavored sauces. In one embodiment, the custom condiment dispenser dispensed the custom condiment directly onto a piece of food, for example a hamburger, a hot dog, or a sandwich located in the dispensing area below the nozzle. In another embodiment, the custom condiment is dispensed into a portion cup to be provided to a customer along with a food order. In both of these two examples, the contemplated dispense volume may be between 0.5 oz to 2.0 oz. In a still further embodiment, the custom condiment dispenser may be used in a "behind-the-counter" use to make specialty sauces which are dispensed into a dispensing container (e.g. a ketchup bottle) either for use by a food preparation worker to dispense onto prepared food or for placing at a table or station for use by a customer. In a non-limiting embodiment, such volumes of dispensing containers may exemplarily be 6 oz-12 oz. These disclosed ranges are merely exemplary of potential uses of the disclosed custom condiment dispenser, it will be recognized that alternative embodiments may be used to dispense between 2 oz and 6 oz, or other volumes above or below this range.

In the present Description, certain terms have been used for brevity, clearness, and understanding. No unnecessary limitation are to be implied therefrom beyond the requirement of the prior art because such terms are used for descriptive purposes only and are intended to be broadly construed. The different dispenser apparatuses, systems, and methods described herein may be used alone or in combination with other apparatuses, systems, and methods. Various equivalents, alternatives, and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A nozzle for dispensing an edible product, the nozzle comprising:

a nozzle sleeve having a wall and defining an open interior;

a nozzle insert positioned within the nozzle sleeve;

a base inlet opening into a base chamber within the open interior of the nozzle sleeve and defined between an interior of the wall of the nozzle sleeve and an exterior of an insert wall of the nozzle insert; and a flavoring inlet defined in the nozzle insert; wherein the nozzle sleeve and the nozzle insert are configured to mix by shear mixing a base substance received through the base inlet with at least one flavoring substance received through the flavoring inlet; and a nozzle outlet defined by the nozzle insert and the nozzle sleeve; and the nozzle insert comprising an elastomer seal that occludes at least the base chamber at the nozzle outlet.

2. The nozzle of claim 1, further comprising a flavoring chamber located below the flavoring inlet, wherein the at least one flavoring substance is received through the flavoring chamber prior to mixing with the base substance.

3. The nozzle of claim 1, further comprising an annular restriction defined between the nozzle sleeve and the nozzle insert.

4. The nozzle of claim 3, wherein the annular restriction fluidly connects the base chamber to an outlet of the nozzle and is configured to produce a flow base substance that promotes shear mixing with a flow of at least one flavoring substance.

5. The nozzle of claim 1, wherein the flavoring inlet comprises a plurality of flavoring barbs directed into the nozzle insert, each of the flavoring barbs configured to connect to a tube through which a flow of a flavoring substance is provided.

6. The nozzle of claim 1, wherein the nozzle comprises an annular restriction defined between the nozzle sleeve and the nozzle insert between the base chamber and the nozzle outlet and the elastomer seal occludes the annular restriction.

7. The nozzle of claim 1, wherein the flavoring inlet is one of a plurality of flavoring inlets defined in the nozzle insert, each of the plurality of flavoring inlets connected to a separate flavoring channel defined between the nozzle sleeve and the nozzle insert.

8. The nozzle of claim 1, further comprising a variable dimension in a cross-sectional diameter of the base chamber.

9. The nozzle of claim 8, wherein the base chamber tapers towards an outlet of the nozzle.

10. The nozzle of claim 1, wherein a cross sectional area of the base chamber is greater than a cross-sectional area of the nozzle insert.

* * * * *